US011466429B2

(12) United States Patent
Ness et al.

(10) Patent No.: US 11,466,429 B2
(45) Date of Patent: Oct. 11, 2022

(54) PRIME MOVER MOUNTABLE HYDRAULIC TOOL AND RELATED MONITORING SYSTEMS AND METHODS

(71) Applicant: Stanley Black & Decker, Inc., New Britain, CT (US)

(72) Inventors: Reuben D. Ness, Mulino, OR (US); Andrew Weisbeck, Portland, OR (US); Aaron J. Brown, Portland, OR (US); Matthew Mecklin, Two Harbors, MN (US)

(73) Assignee: Stanley Black & Decker, Inc., New Britain, CT (US)

( * ) Notice: Subject to any disclaimer, the term of this patent is extended or adjusted under 35 U.S.C. 154(b) by 200 days.

(21) Appl. No.: 16/750,512

(22) Filed: Jan. 23, 2020

(65) Prior Publication Data

US 2021/0230834 A1 Jul. 29, 2021

(51) Int. Cl.
*E02F 9/08* (2006.01)
*E02F 9/02* (2006.01)
(Continued)

(52) U.S. Cl.
CPC ..... *E02F 9/0858* (2013.01); *E02F 9/226* (2013.01); *E02F 9/2221* (2013.01); *E02F 9/267* (2013.01); *F15B 19/005* (2013.01)

(58) Field of Classification Search
CPC ..... E02F 3/965; E02F 9/0858; E02F 9/2221; E02F 9/226; E02F 9/2275; E02F 9/264;
(Continued)

(56) References Cited

U.S. PATENT DOCUMENTS 4,744,239 A 5/1988 Kyrtsos et al.
4,845,975 A 7/1989 Kyrtsos et al.
(Continued)

FOREIGN PATENT DOCUMENTS

CN 106197886 A 12/2016
DE 102016200924 A1 7/2017
(Continued)

OTHER PUBLICATIONS

International Search Report and Written Opinion dated Aug. 30, 2021 in corresponding International Patent Application No. PCT/EP2021/051056.
(Continued)

*Primary Examiner* — Tyler J Lee
(74) *Attorney, Agent, or Firm* — Harness, Dickey & Pierce, P.L.C.

(57) ABSTRACT

A hydraulic tool with a protective box assembly including a control circuit and hydraulic pressure sensors is used to operate a prime mover. The control circuit and the hydraulic pressure sensors are used to monitor performance of the hydraulic tool. Systems and methods implemented in a cloud monitor the performance of the hydraulic tool. The systems and methods utilize data collected by the hydraulic pressure sensors, processed by the control circuit, and transmitted via an antenna from the hydraulic tool to the cloud. A first set of systems and methods detect and predict a jam condition in blades associated with the hydraulic tool using statistical analysis of the data. A second set of systems and methods detect faults associated with the hydraulic tool including hydraulic leakage, mechanical wear, and friction.

10 Claims, 25 Drawing Sheets

(51) Int. Cl.

| | |
|---|---|
| ***E02F 9/22*** | (2006.01) |
| ***E02F 9/26*** | (2006.01) |
| ***F15B 19/00*** | (2006.01) |

(58) Field of Classification Search
CPC . E02F 9/267; F15B 19/005; F15B 2211/6313; F15B 2211/864; F15B 2211/87
See application file for complete search history.

(56) References Cited

U.S. PATENT DOCUMENTS

| | | | | |
|---|---|---|---|---|
| 4,887,454 | A | 12/1989 | Kyrtsos et al. | |
| 5,542,180 | A | 8/1996 | Karani | |
| 6,510,902 | B1 | 1/2003 | Prokop et al. | |
| 6,817,228 | B2 | 11/2004 | Upton et al. | |
| 7,324,880 | B2 | 1/2008 | Lueschow et al. | |
| 7,418,331 | B2 | 8/2008 | Lueschow | |
| 8,863,640 | B2 | 10/2014 | Hill et al. | |
| 9,605,415 | B2 * | 3/2017 | Edara | G01M 99/005 |
| 9,650,882 | B2 | 5/2017 | Zhang et al. | |
| 9,671,065 | B2 | 6/2017 | Conley et al. | |
| 10,967,380 | B2 * | 4/2021 | Johnson | B02C 1/06 |
| 2016/0076226 | A1 * | 3/2016 | Edara | G07C 5/0841 701/25 |
| 2017/0125146 | A1 | 5/2017 | Shiki et al. | |

FOREIGN PATENT DOCUMENTS

| | | | |
|---|---|---|---|
| EP | 1580440 | A1 | 9/2005 |
| EP | 2839169 | A1 | 2/2015 |
| GB | 2185730 | A | 7/1987 |
| JP | 61055405 | A2 | 3/1986 |
| JP | 2001132020 | A | 5/2001 |
| KR | 20160107746 | A | 9/2016 |
| SU | 1267070 | A1 | 10/1986 |
| WO | WO-2017/210308 | A1 | 12/2017 |
| WO | WO-2020/010013 | A1 | 1/2020 |

OTHER PUBLICATIONS

Stanley Infrastructure, InSite™ 516571 User Manual, Ver. 5, Apr. 2019, LaBounty®.

International Preliminary Report on Patentability dated Aug. 4, 2022 in corresponding International Patent Application No. PCT/EP2021/051056.

* cited by examiner

PRIME MOVER MOUNTABLE HYDRAULIC TOOL AND RELATED MONITORING SYSTEMS AND METHODS

FIELD

The present disclosure relates to large hydraulic tools that are mounted onto a prime mover, such as an excavator, during use.

BACKGROUND

This section provides background information related to the present disclosure which is not necessarily prior art.

Earth movers often use hydraulic tools to perform various operations. Sensors for monitoring the operations of the hydraulic tools are typically distributed at multiple locations on and around the hydraulic tools. These sensors are exposed to harsh environments including harsh temperatures, vibrations, dirt, rain, snow, and so on. Exposure to harsh environments can adversely affect the longevity of the sensors and the ability of the sensors to function reliably. Further, the hydraulic tools often encounter problems during operation, which can cause the hydraulic tools and the earth movers to be out of service for a period of time. The downtimes can adversely affect productivity of the earth movers and can be costly.

SUMMARY

This section provides a general summary of the disclosure, and is not a comprehensive disclosure of its full scope or all of its features.

In accordance with an aspect of the present disclosure, a prime mover mountable hydraulic tool can include a protective box assembly. The protective box assembly can house a combination including a bore-side and a rod-side hydraulic pressure sensor, a control circuit, and a wireless transmitter antenna. The wireless transmitter antenna can provide a communication channel to a user interface independent of any communication channel provided by the prime mover. The protective box assembly can be mounted to a mounting wall of the prime mover mountable hydraulic tool. A bore-side hydraulic fluid passage can extend between the bore-side hydraulic pressure sensor within the protective box assembly and a cylinder bore-side block port. The bore side hydraulic fluid passage can include a bore-side hydraulic jump hose and a bore-side snubber. A rod-side hydraulic fluid passage can extend between the rod-side hydraulic pressure sensor within the protective box assembly and a cylinder rod-side block port. The rod-side hydraulic fluid passage can include a rod-side hydraulic jump hose and a rod-side snubber. A port block can be mounted within an interior of the protective box assembly. The port block can provide a portion of each of the bore-side and rod-side hydraulic fluid passages, respectively. The port block can provide replacement bore-side and rod-side ports coupled to the bore-side and rod-side hydraulic fluid passages, respectively. The replacement bore-side and rod-side ports can replace the bore-side and rod-side ports to which the bore-side and rod-side hydraulic fluid passages are coupled, respectively. An electrical power source coupling can be mounted on the protective box assembly and can be operably coupled to transfer power to the control circuit, the wireless transmitter antenna, and the bore-side and rod-side hydraulic pressure sensors mounted within the protective box assembly.

In accordance with another aspect of the present disclosure, a system for detecting jamming of a component operated by the prime mover mountable hydraulic tool can include a data acquisition module, a data processing module, and a jam detection module implemented in a cloud. The data acquisition module can acquire a time series data regarding bore pressure and rod pressure from sensors monitoring a hydraulic cylinder operating a blade associated with an earth moving equipment. The data processing module can divide the time series data into a plurality of windows of a predetermined duration and identify times at which bore pressure and rod pressure peak in the windows. The data processing module can determine durations between successive pairs of bore and rod pressure peaks, where in each pair, a rod pressure peak follows a bore pressure peak. The jam detection module can detect a jamming of the blade when one of the durations is less than or equal to a predetermined threshold. The jam detection module can detect a probability of the blade jamming when the durations between the successive pairs of bore and rod pressure peaks decrease with time. The system can include a statistical analysis module that can generate a Z score based on the durations between successive pairs of bore and rod pressure peaks and detect the jamming of the blade and/or the probability of the blade jamming based on the Z score. The system can also detect and/or predict the jamming of the blade based on area under the curve of the rod pressure. The system can transmit a message indicating the jamming of the blade and/or the probability of the blade jamming to a computing device such as a smartphone.

In accordance with another aspect of the present disclosure, a system for detecting faults in the prime mover mountable hydraulic tool can include a receiver and a processor implemented in a cloud. The receiver can receive data via a network from a first sensor sensing pressure on a bore side of a hydraulic cylinder associated with the hydraulic tool, and from a second sensor sensing pressure on a rod side of the hydraulic cylinder associated with the hydraulic tool. The processor can determine first baseline values of the pressures on the bore side and the rod side of the hydraulic cylinder based on the data received from the first and second sensors during a first test operation, such as a stall test, performed by the hydraulic cylinder at a first time. After the hydraulic tool is used for some time, the processor can determine second baseline values of the pressures on the bore side and the rod side of the hydraulic cylinder based on the data received from the first and second sensors during a second test operation, such as a stall test performed by the hydraulic cylinder at a second time. A mobile device can be used to initiate the first and second test operations performed by the hydraulic cylinder at the first and second times. The processor can detect an abnormality associated with the hydraulic cylinder based on the first and second baseline values of the pressures on the bore side and the rod side of the hydraulic cylinder. The abnormality can include one or more of a fluid leakage, mechanical wear, and friction. The system can transmit a message to a mobile device via the network indicating detection of the abnormality associated with the hydraulic cylinder.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
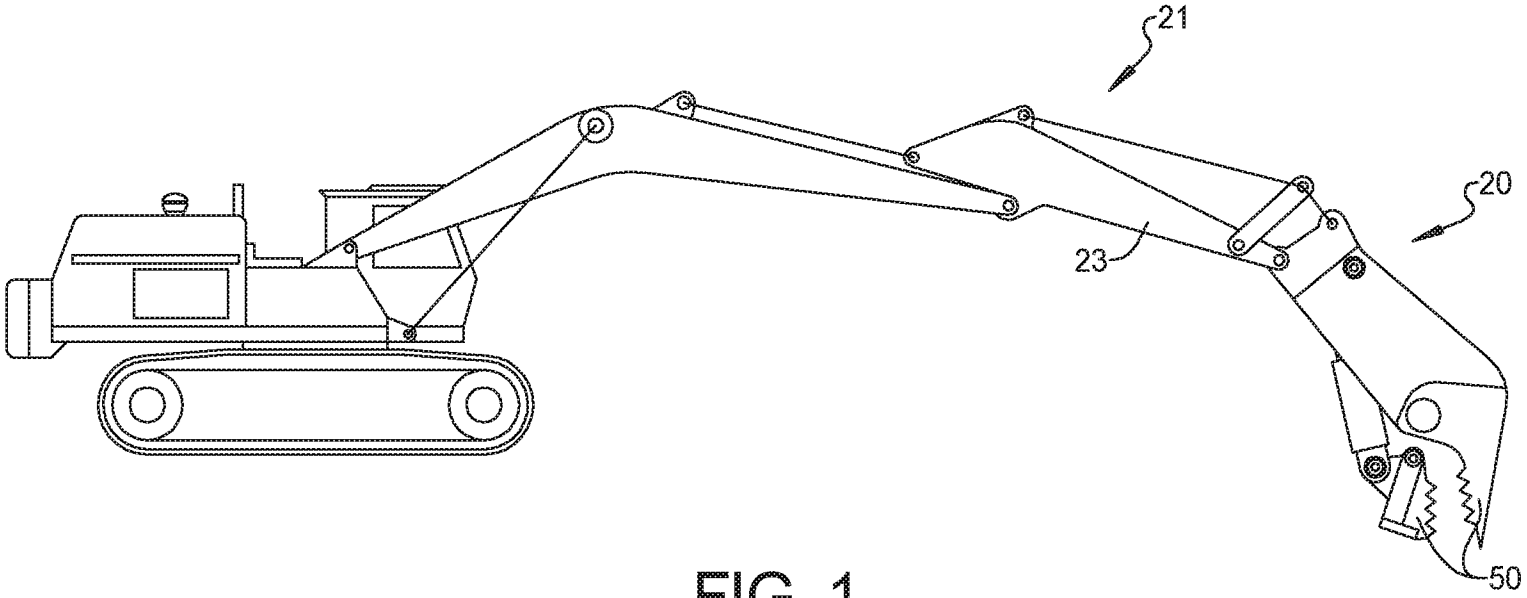
FIG. 1 is a side elevation view of one example prime mover mountable hydraulic tool in accordance with the present disclosure mounted to one example prime mover.
Figure 2:
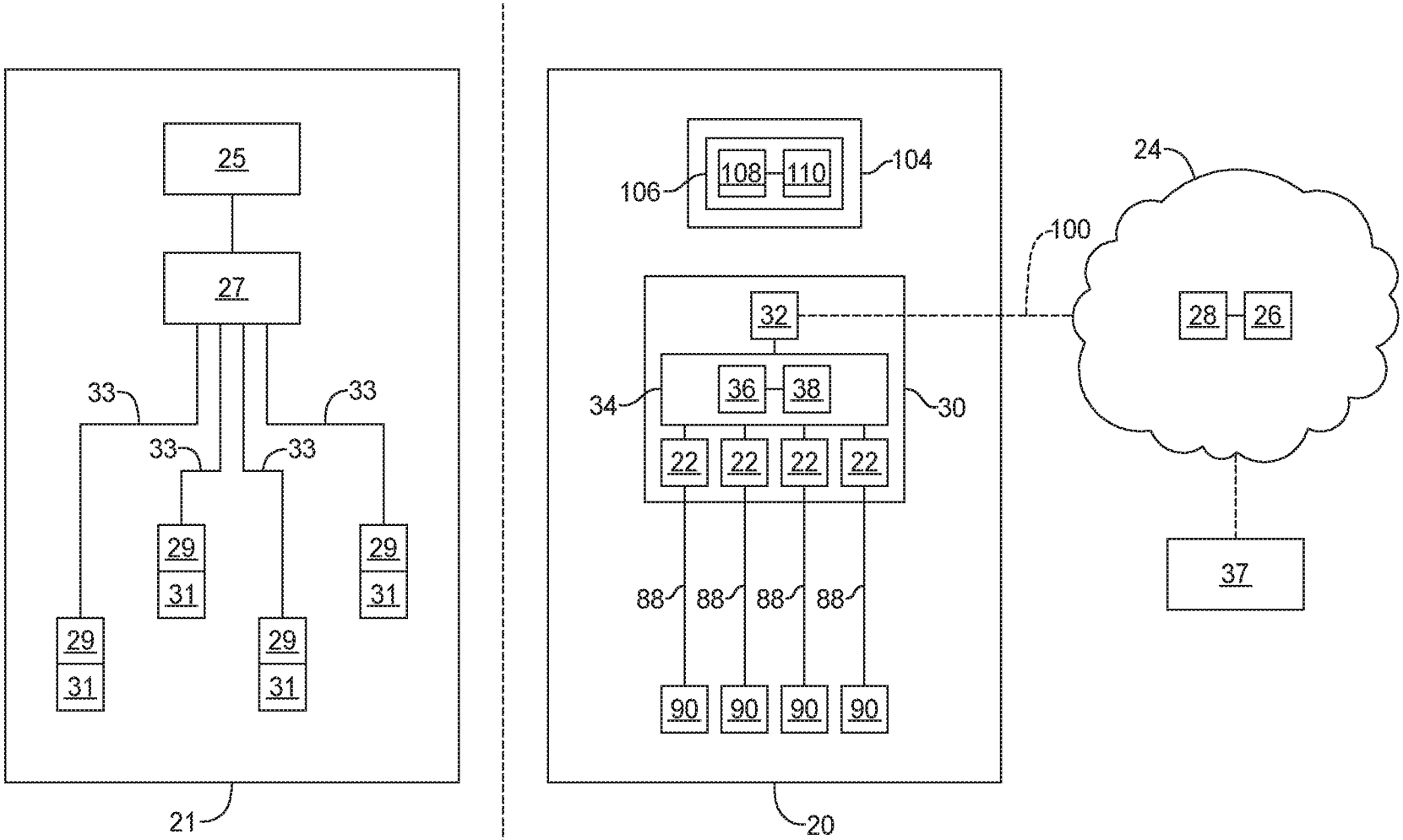
FIG. 2 is a schematic diagram of various components of the example prime mover mountable hydraulic tool of FIG. 1 and its environment, including independent components of the example prime mover.
Figure 3:
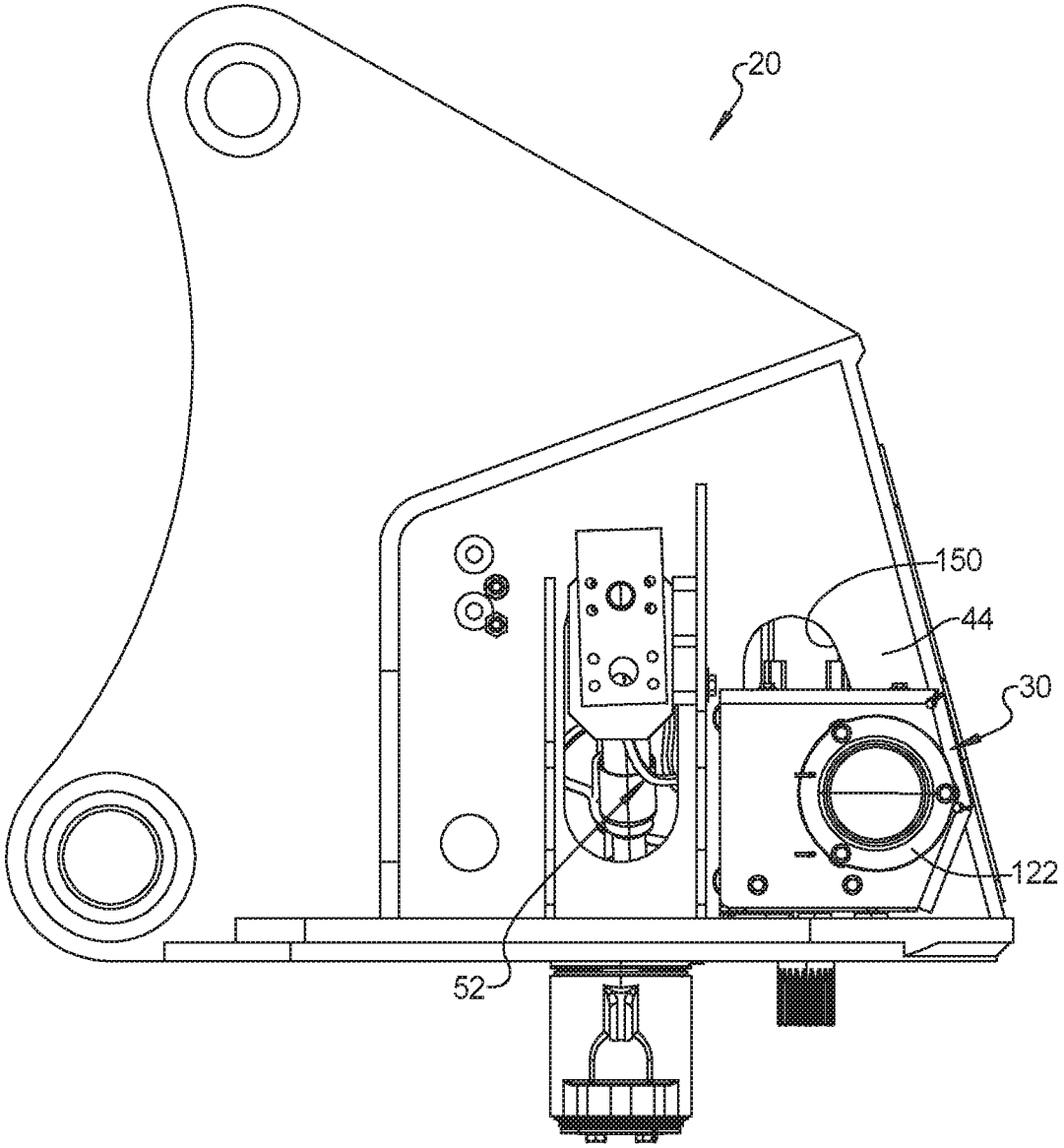
FIG. 3 is a side elevation view of various components of the example prime mover mountable hydraulic tool of FIG. 1, including a main housing.
Figure 4:
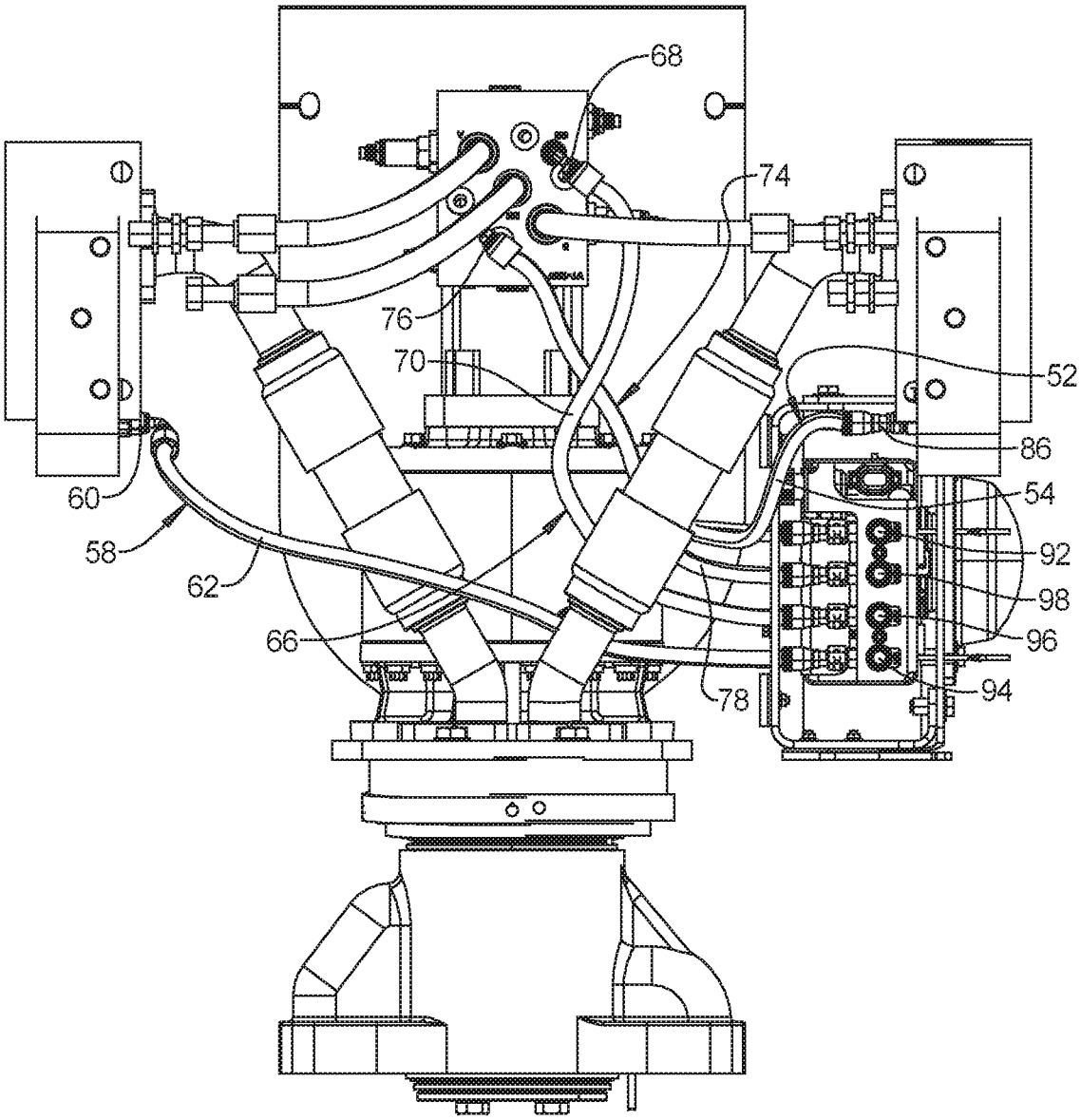
FIG. 4 is another side elevation view of various components of FIG. 3, but with the main housing removed for clarity.
Figure 5:
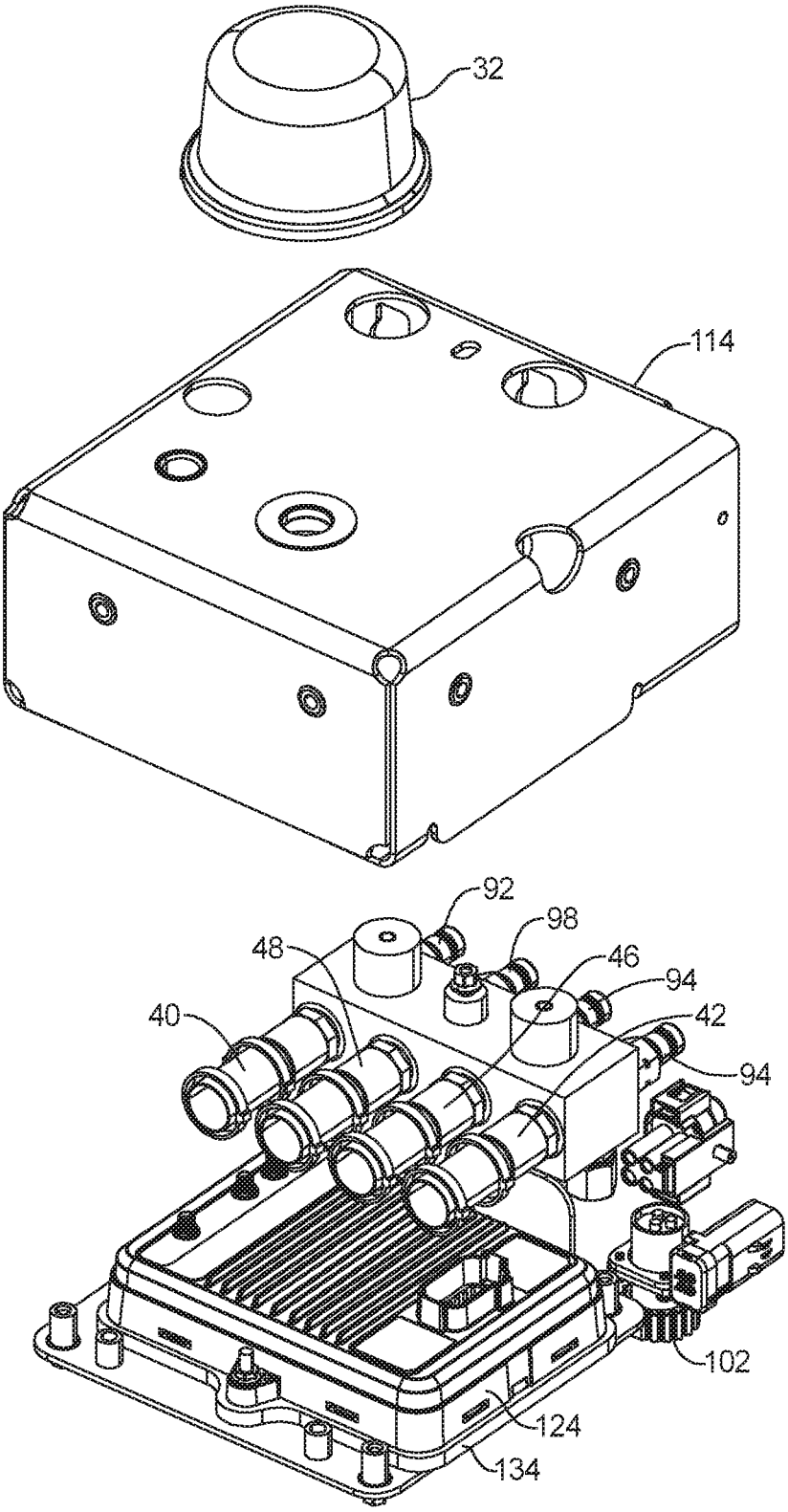
FIG. 5 is an exploded perspective view of various components related to two compartments of an example protective box assembly of the example prime mover mountable hydraulic tool of FIG. 1.
Figure 6:
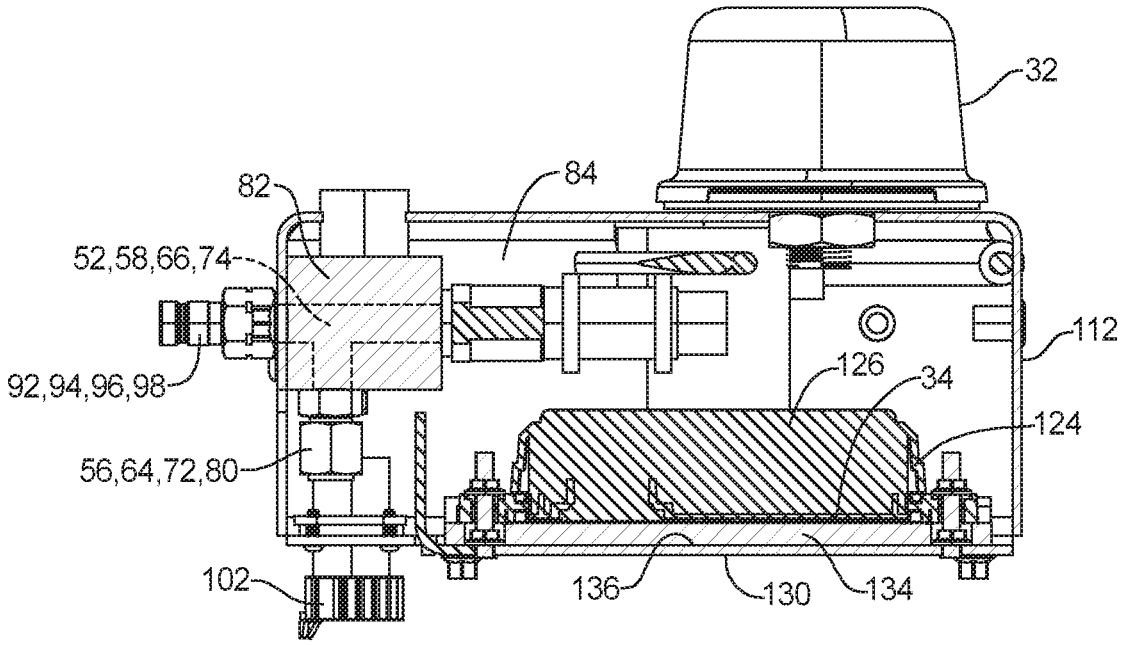
FIG. 6 is a cross-section view including the various components of FIG. 5 of the example protective box assembly.
Figure 7:
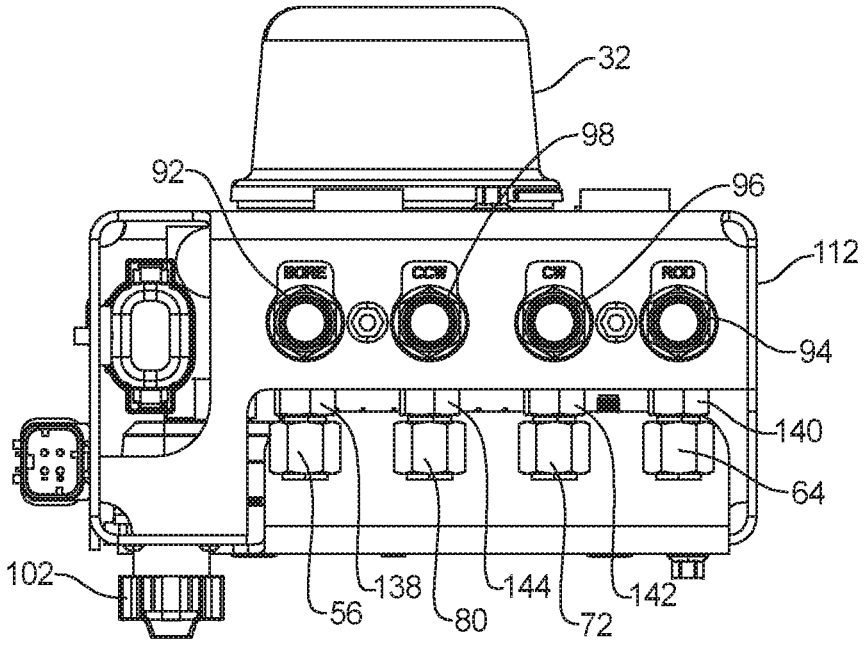
FIG. 7 is a side elevation view including the various components of FIG. 5 of the example protective box assembly.
Figure 8:
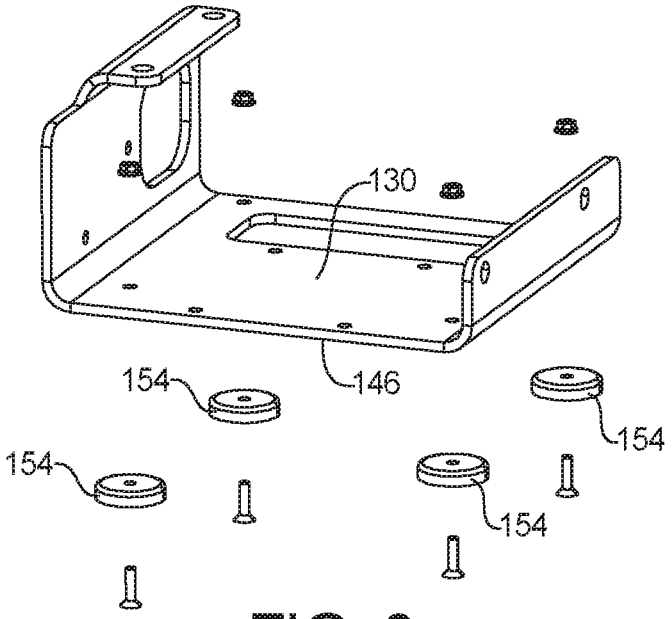
FIG. 8 is an exploded perspective view of various components related to another compartment of the example protective box assembly of the example prime mover mountable hydraulic tool of FIG. 1.
Figure 9:
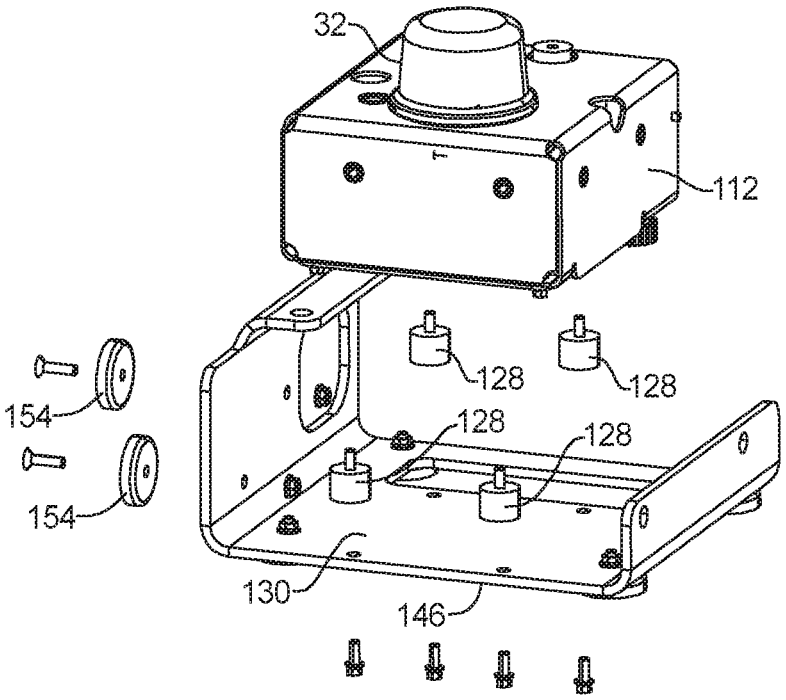
FIG. 9 is an exploded perspective view including the various components of FIGS. 7 and 8 of the example protective box assembly.
Figure 10:
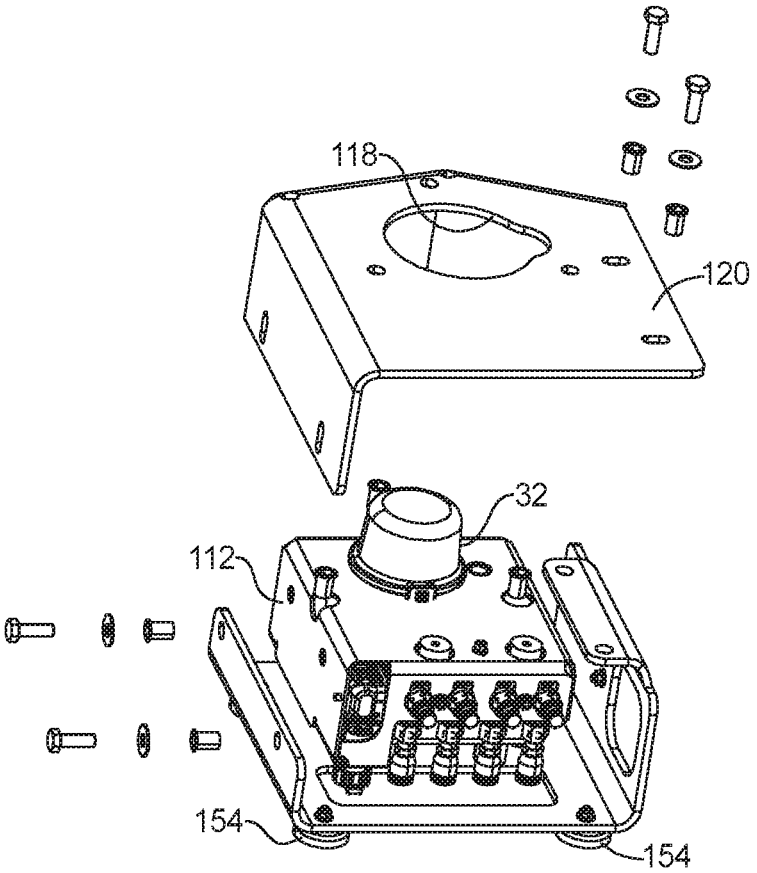
FIG. 10 is an exploded perspective view including the various components of FIG. 9 of the example protective box assembly.
Figure 11:
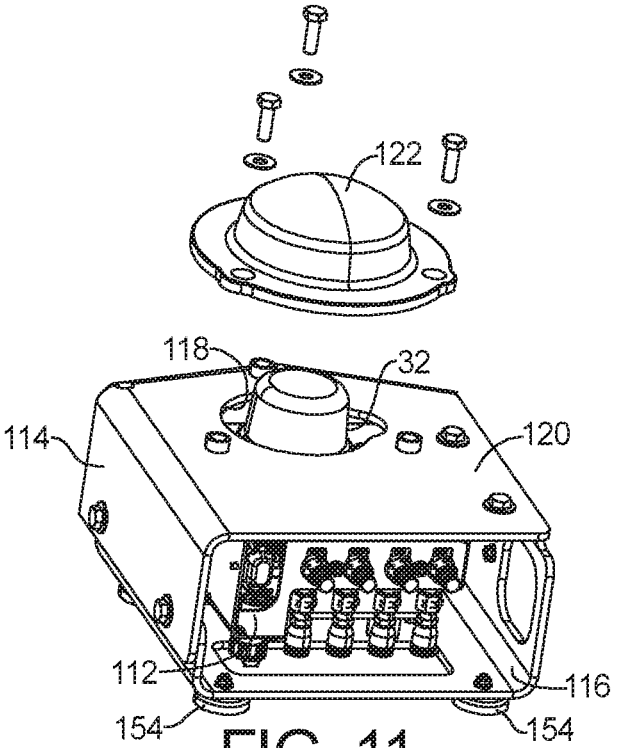
FIG. 11 is an exploded perspective view including the various components of FIG. 10 of the example protective box assembly.
Figure 12:
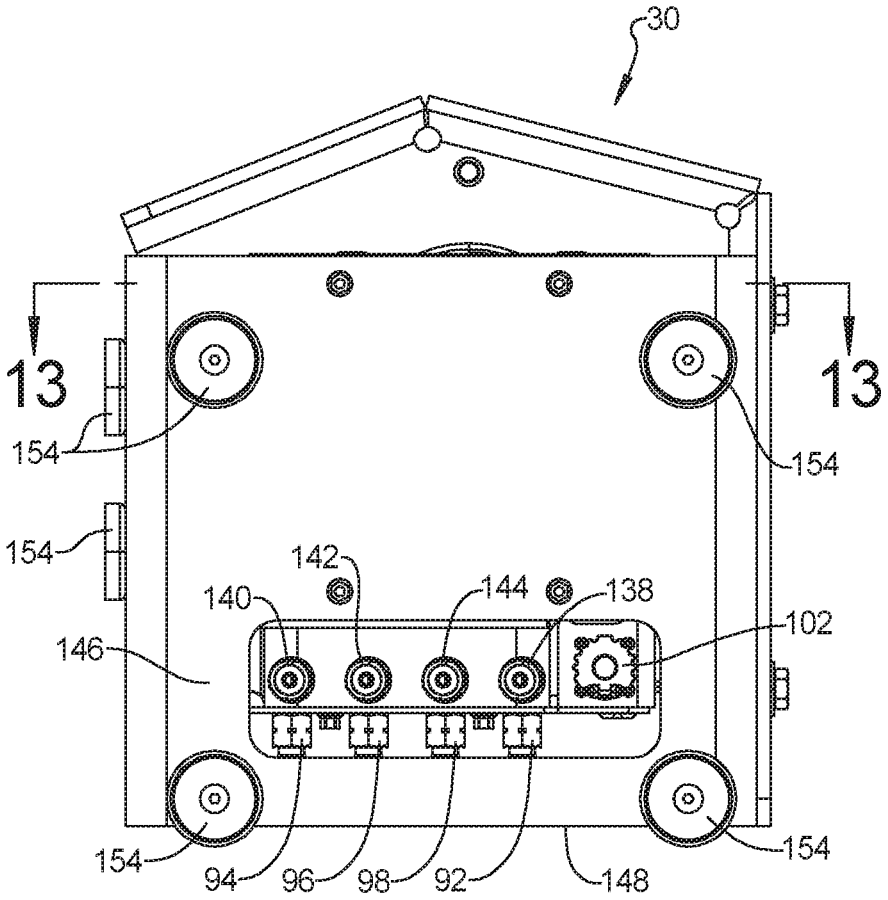
FIG. 12 is a bottom plan view of the example protective box assembly of the example prime mover mountable hydraulic tool of FIG. 1.
Figure 13:
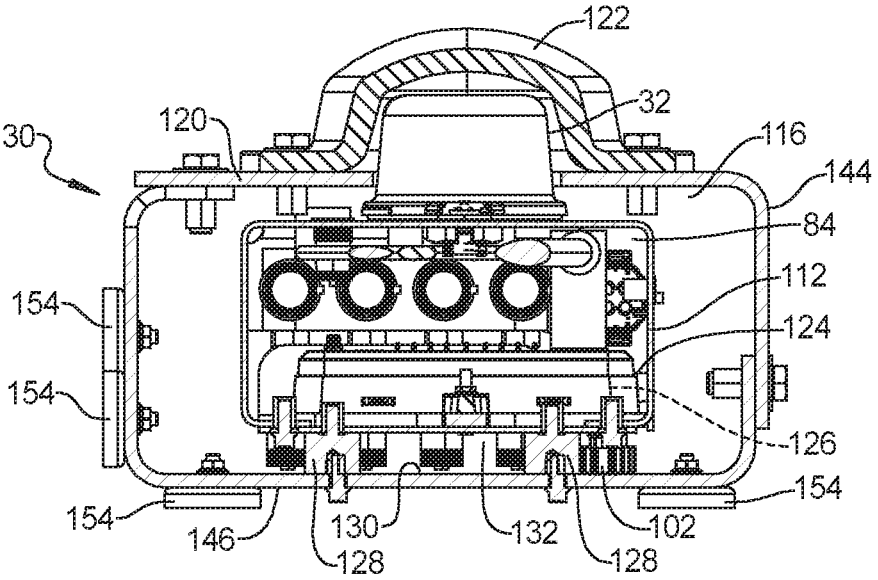
FIG. 13 is a cross-section view of the example protective box assembly through line 13-13 of FIG. 12.

Example embodiments will now be described more fully with reference to the accompanying drawings.

FIGS. 1-13 illustrate one example of a prime mover mountable hydraulic tool 20 in accordance with the present disclosure. The prime mover 21 can include a boom 23 to which the hydraulic tool 20 is mounted during use. The prime mover 21 typically includes a prime mover user interface 25 coupled to a prime mover control circuit 27. Typically, a plurality of prime mover hydraulic pressure sensors 29 that are spaced at block ports 31 in different locations around the prime mover 21 are each coupled to the prime mover control circuit 27 via relatively long runs of electrical cables 33.

The hydraulic tool 20 can include a protective box assembly 30 mounted to a mounting wall 44 of the hydraulic tool 20. The protective box assembly 30 houses a combination of components that can include a control circuit 34, which can include a microprocessor 36 and memory 38, coupled to a plurality of hydraulic pressure sensors 22 and to a wireless transmitter antenna 32 that provides a communication channel 100 to a user interface 37 independent of any communication channel provided by the prime mover 21. For example, the wireless communication channel 100 can be between the hydraulic tool 20 and a computing cloud 24 including microprocessors 26 and memory 28. The cloud 24 can be in communication with a user interface 37. The user interface 37 can be provided, for example, by a phone or a computer.

The hydraulic pressure sensors 22 that are housed within the protective box assembly 30 can include a bore-side hydraulic pressure sensor 40 and a rod-side hydraulic pressure sensor 42 of a hydraulic cylinder, and can include a clockwise rotation hydraulic pressure sensor 46 and a counterclockwise rotation hydraulic pressure sensor 48 of a hydraulic motor(s). For example, the hydraulic cylinder can be used to open and close jaws or blades 50 of the hydraulic tool 20, and the hydraulic motor(s) can be used to rotate the hydraulic tool 20, including its jaws or blades 50, clockwise and counterclockwise. Throughout the present disclosure, a hydraulic tool with a single hydraulic cylinder is described for example only. The teachings of the present disclosure apply equally to hydraulic tools with multiple hydraulic cylinders.

A hydraulic fluid passage 88 can extend between each of the co-located hydraulic pressure sensors 22 its respective one of a plurality of block ports 90 spaced around the hydraulic tool 20. For example, a bore-side hydraulic fluid passage 52 can extend between a cylinder bore-side block port 86 and the bore-side hydraulic pressure sensor 40 within the protective box assembly 30. The bore side hydraulic fluid passage 52 can include a bore-side hydraulic jump hose 54 and a bore-side snubber 56. A rod-side hydraulic fluid passage 58 can extend between a cylinder rod-side block port 60 and the rod-side hydraulic pressure sensor 42 within the protective box assembly 30. The rod-side hydraulic fluid passage 58 can include a rod-side hydraulic jump hose 62 and a rod-side snubber 64.

A clockwise rotation hydraulic fluid passage 66 can extend between a motor clockwise rotation block port 68 and the clockwise rotation hydraulic pressure sensor 46 within the protective box assembly 30. The clockwise rotation hydraulic fluid passage 66 can include a clockwise rotation hydraulic jump hose 70 and a clockwise rotation snubber 72. A counterclockwise rotation hydraulic fluid passage 74 can extend between a motor counterclockwise rotation block port 76 and the counterclockwise rotation hydraulic pressure sensor 48 within the protective box assembly 30. The counterclockwise rotation hydraulic fluid passage 74 can include a counterclockwise rotation hydraulic jump hose 78 and a counterclockwise rotation snubber 80.

A port block 82 can be mounted within an interior 84 of the protective box assembly 30. The port block 82 can provide a portion of each of the bore-side, rod-side, clockwise rotation, and counterclockwise rotation hydraulic fluid passages, 52, 58, 66, and 74 respectively. The port block 82 can provide replacement bore-side, rod-side, clockwise rotation, and counterclockwise rotation ports, 92, 94, 96, and 98 respectively, that are coupled to the bore-side, rod-side, clockwise rotation, and counterclockwise rotation hydraulic fluid passages, 52, 58, 66, and 74 respectively.

These replacement bore-side, rod-side, clockwise rotation, and counterclockwise rotation ports, 92, 94, 96, and 98 respectively, can be replacements for the bore-side, rod-side, clockwise rotation, and counterclockwise rotation block ports, 86, 60, 68, and 76 respectively, to which the bore-side, rod-side, clockwise rotation, and counterclockwise rotation hydraulic fluid passages, 52, 58, 66, and 74 respectively, are coupled. For example, the bore-side, rod-side, clockwise rotation, and counterclockwise rotation block ports, 86, 60, 68, and 76 respectively, can be block test ports and the replacement bore-side, rod-side, clockwise rotation, and counterclockwise rotation ports, 92, 94, 96, and 98 respectively, of the port block 82 of the protective box assembly 30 can be replacement block test ports.

Because all of the hydraulic pressure sensors 40, 42, 46, 48 are co-located together within the protective box assembly 30, the hydraulic jump lines or hoses 54, 62, 70, and 78 run between the spaced apart bore-side, rod-side, clockwise rotation, and counterclockwise rotation block ports, 86, 60, 68, and 76 respectively, and the bore-side, rod-side, clockwise rotation, and counterclockwise rotation sensors, 40, 42, 46, and 48 respectively, that are co-located with the control circuit 34 within the protective box assembly 30. This is in contrast to the electrical lines or cables 33 running between the prime mover hydraulic pressure sensors 29 that are spaced away from the prime mover control circuit 27 and spaced apart from each other at the various corresponding block ports 31 located around the prime mover 21. This can be advantageous, because hydraulic tool mechanics are much more knowledgeable about how to properly run hydraulic lines or hoses around a hydraulic tool to avoid damaging the hydraulic lines or other problems during tool operation, than about how to properly run electrical lines around a hydraulic tool without resulting in problems.

A "snubber" comprises a hydraulic fluid flow restriction in a hydraulic fluid passage (e.g., 52, 58, 66, and 74) that dampens rapid pressure shocks and fluctuations in order to protect hydraulic components (e.g., sensors 40, 42, 46, 48). As examples, the snubbers 56, 64, 72, 80 can be individual components coupled between the respective hydraulic jump hose and block motor and cylinder ports, or between the respective hydraulic jump hose and the port block 82 within the protective box assembly 30. As another example, the snubbers 56, 64, 72, 80 can be integrally formed as part of the port block 82 within the protective box assembly 30.

An electrical power source coupling 102 can be mounted to the protective box assembly 30. The electrical power source coupling 102 can be operably coupled to transfer power from the coupling 102 to the control circuit 34, the wireless transmitter antenna 32, and the hydraulic pressure sensors 22 mounted within the protective box assembly. The hydraulic tool 20 can include an electrical power source 104 that is coupled to the electrical power source coupling 102.

The electrical power source 104 of the hydraulic tool 20 can provide electrical power to the protective box assembly 30 independent of any electrical power provided by the prime mover 21. The electrical power source 104 can include an electrical power generation assembly 106 that can include a hydraulic motor 108 that is operably coupleable to hydraulic lines from the prime mover 21 to be driven by hydraulic fluid from the prime mover 21 when coupled thereto. An electrical generator 110 can be driven by the hydraulic motor 108 to produce electricity on board the hydraulic tool 20 itself. One example independent electrical power generation assembly 106 for a prime mover mountable hydraulic tool 20 is described in commonly-assigned U.S. patent application Ser. No. 16/478,829 filed on Jul. 17, 2019 and entitled "Excavator Boom Mountable High Pressure Hydraulic Tool Including a Hydraulic Motor Driven Generator," which is hereby incorporated herein by reference in its entirety.

The protective box assembly 30 can include a first compartment 112 to which the wireless transmitter antenna 32 is mounted. Alternatively, the wireless transmitter antenna 32 can be mounted outside the protective box assembly 30. The first compartment 112 can have a first compartment interior 84 in which each of the control circuit 34, and the bore-side, rod-side, clockwise rotation, and counterclockwise rotation hydraulic pressure sensors 40, 42, 46, 48 can be mounted. The protective box assembly 30 can include a second compartment 114 having a second compartment interior 116 in which the first compartment can be mounted. The wireless transmitter antenna 32 can extend through an aperture 118 in wall 120 of second compartment 114. A protective antenna cover 122 can be coupled to the wall 120 of the second compartment 116 and can extend over the wireless transmitter antenna 32. The protective box assembly 30 can include a third compartment 124 mounted within the first compartment interior 84. The third compartment 124 can have a third compartment interior 126 in which the control circuit 34 can be mounted.

The protective box assembly 30 can include a first vibration dampener 128 operably positioned between an interior surface 130 of the second compartment 114 and an exterior surface 132 of the first compartment 112. More generally, the protective box assembly 30 can include a first vibration dampener 128 operably positioned between the mounting wall 44 and each of the control circuit 34, and hydraulic pressure sensors 40, 42, 46, 48 and the wireless transmitter antenna 32. A second vibration dampener 134 can be operably positioned between an interior surface 136 of the first compartment 112 and the control circuit 34. More generally, the protective box assembly 30 can include a second vibration dampener 134 operably positioned between the first vibration dampener 128 and the control circuit 34.

The port block 82 mounted within the protective box assembly 30 can include bore-side, rod-side, clockwise rotation, and counterclockwise rotation inlet ports, 138, 140, 142, and 144, respectively, of the bore-side, rod-side, clockwise rotation, and counterclockwise rotation fluid passages, 52, 58, 66, and 74, respectively. Each of the bore-side, rod-side, clockwise rotation, and counterclockwise rotation inlet ports, 138, 140, 142, and 144, respectively, of the port block 84 and the electrical coupling 102 each face outwardly along a first common side 146 of the protective box assembly 30. In other words, these inlet ports 138, 140, 142, 144 and the electrical coupling 102 are positioned and oriented so that coupling access to each of them is provided along the first common side 146.

The replacement bore-side, rod-side, clockwise rotation, and counterclockwise rotation ports 92, 94, 96, and 98 respectively, can face outwardly along a second common side 148 of the protective box assembly 30. The second common side 148 of the protective box assembly 30 can be adjacent to the first common side 146. For example, the first common side 146 can be one of two major sides of the protective box assembly, and the second common side 148 can be one of the minor sides spanning between the two major sides.

The first common side 146 of the protective box assembly 30 can face the mounting wall 44 of the hydraulic tool 20. The mounting wall 44 can have an opening 150 therethrough. Each of the bore-side, rod-side, clockwise rotation, and counterclockwise rotation fluid passages 52, 58, 66, and 74, respectively, and an electrical power cable 152 coupled to the electrical power source coupling 102 can pass through the opening 150 in the mounting wall 44 of the hydraulic tool 20. The protective box assembly 30 can include magnets 154 that couple the protective box assembly 30 to the mounting wall 44.

The protective box assembly 30 including the control circuit 34 and the hydraulic pressure sensors 22 can be used in many applications to monitor performance of the hydraulic tool 20. For example, two sets of systems and methods are described below that can monitor performance of the hydraulic tool 20. The two sets of systems and methods are implemented in the cloud 24. The two sets of systems and methods can utilize the data collected by the hydraulic pressure sensors 22, processed by the processor 36 and memory 38 of the control circuit 34, and transmitted via the antenna 32 from the hydraulic tool 20 to the cloud 24. A first set of systems and methods described with reference to FIGS. 14-28 can detect and predict a jam condition in the blades 50 using statistical analysis of the sensor data as explained below in detail. A second set of systems and methods described subsequently with reference to FIGS. 29-33 can detect faults associated with the hydraulic tool 20 such as hydraulic leakage, mechanical wear, friction, and so on as explained below in detail.

Figure 14:
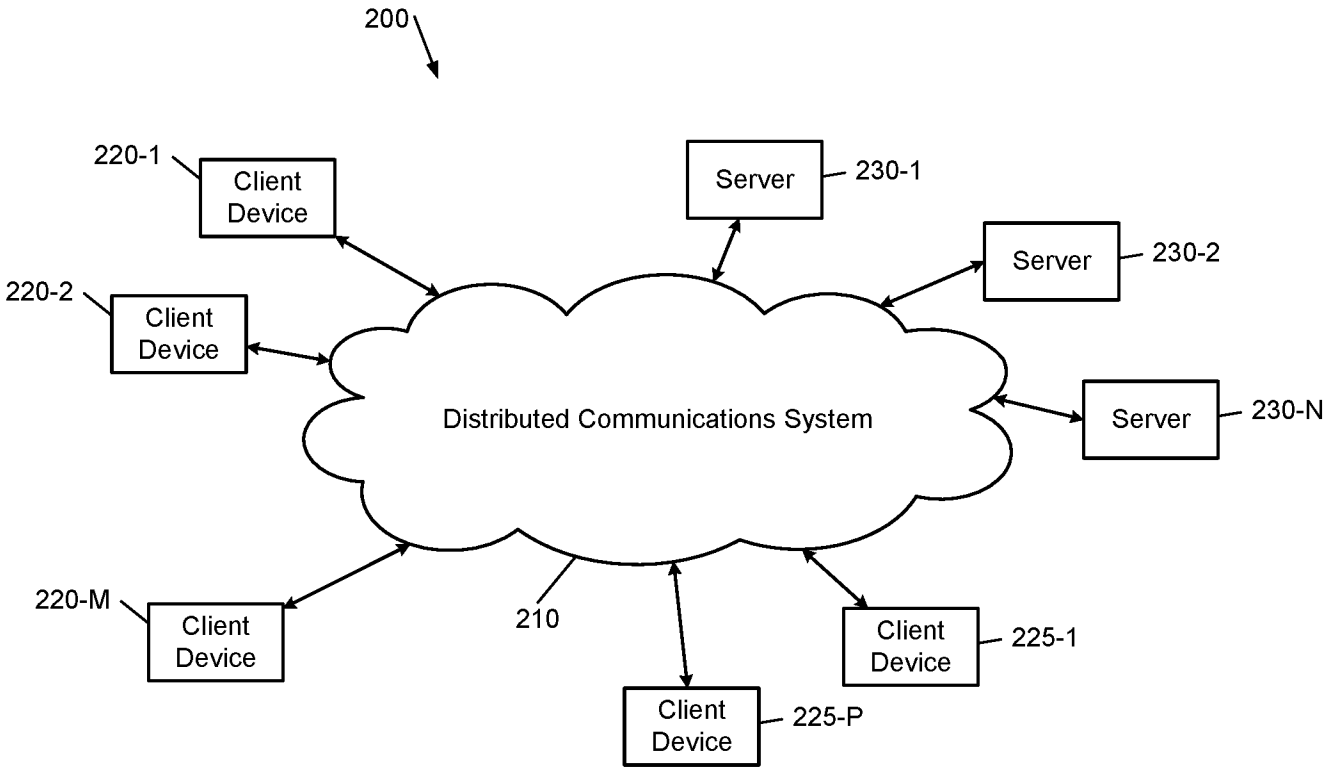
FIGS. 14-16 show an example of a distributed computing system for implementing jam detection and fault detection systems and methods shown in FIGS. 17-32.
Figure 15:
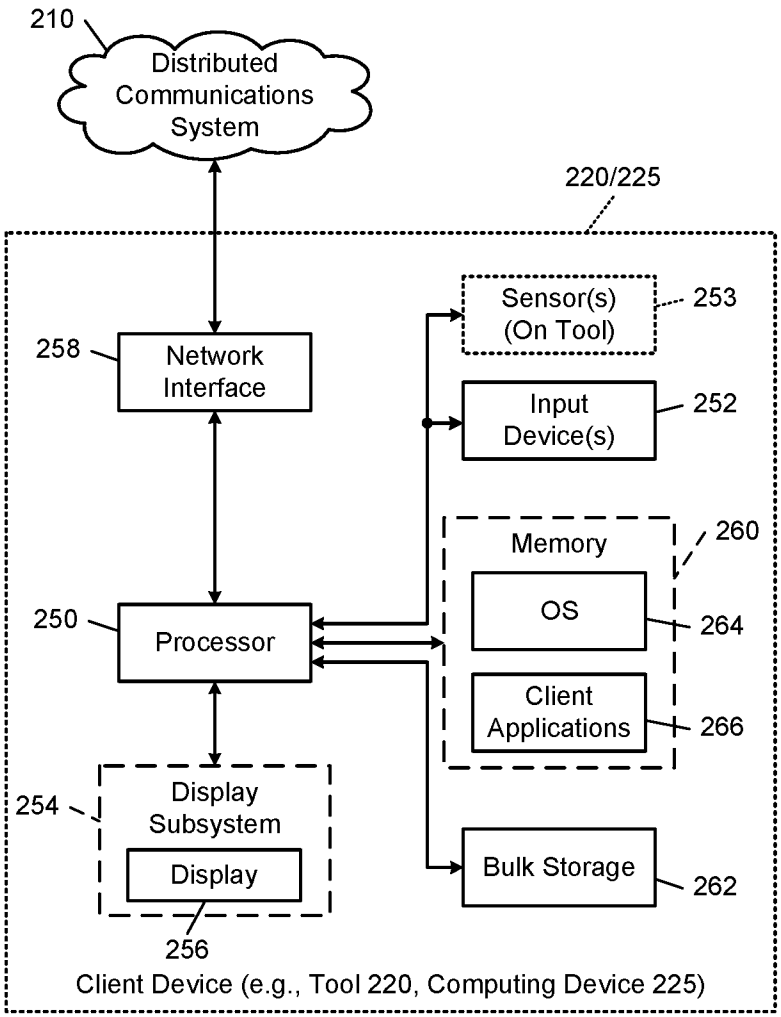
Figure 16:
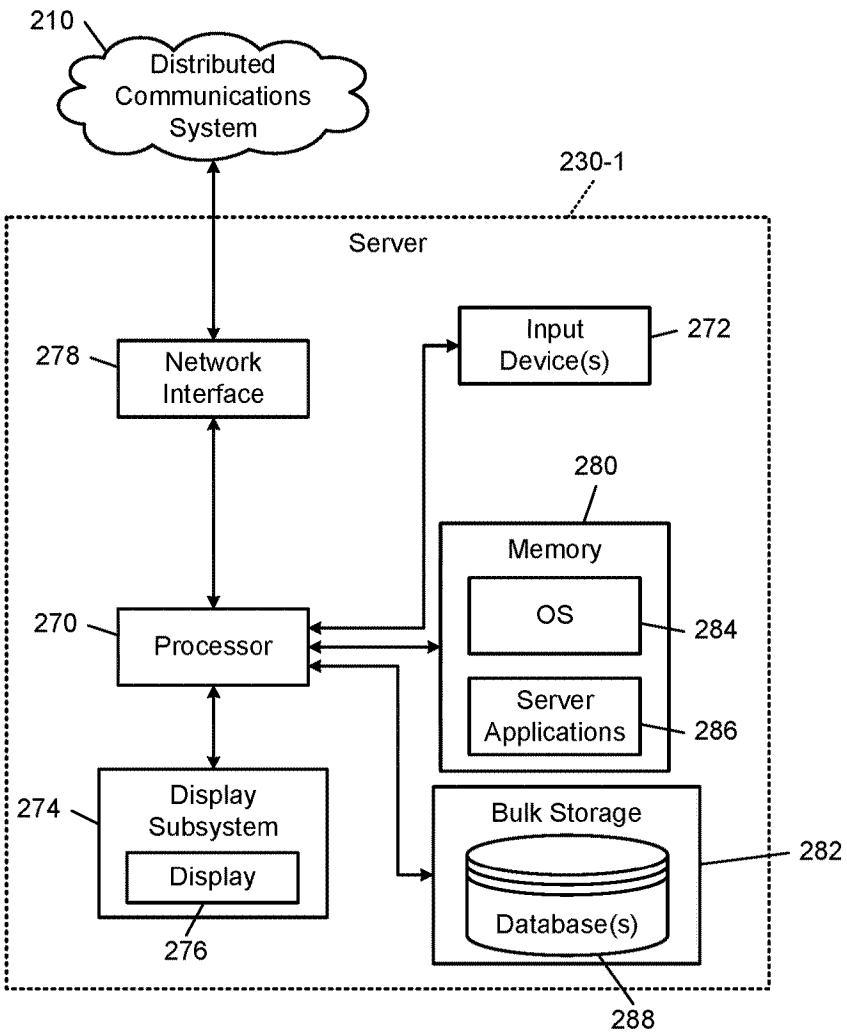

FIGS. 14-28 illustrate examples of systems and methods for detecting jamming of the blades 50 and for maintaining gap between blades 50 of the hydraulic tool 20 in accordance with the present disclosure. Initially, FIGS. 14-16 illustrate an example of a distributed computing system in which the systems and methods for jam detection and gap maintenance can be implemented. The distributed computing system shown in FIGS. 14-16 can also be used to implement the systems and methods shown in FIGS. 29-33 that detect the faults associated with the hydraulic tool 20. FIGS. 17-20 illustrate an example of a system for jam detection and gap maintenance. FIGS. 21-28 illustrate examples of various methods for jam detection and gap maintenance. First, a brief overview of the systems and methods for jam detection and gap maintenance is provided. Thereafter, the systems and methods for jam detection and gap maintenance are described in detail with reference to FIGS. 14-28.

Briefly, the systems and methods for jam detection and gap maintenance use a statistical model to detect and predict jamming of the blades 50. The systems and methods divide raw data received from the hydraulic pressure sensors 22 into windows based on both bore and rod pressures. The windowing is performed using rules to capture fast changes in the raw values. The systems and methods extract relevant features from each window (e.g., peak to peak time, area under the curve, opening time of the blades 50, and so on). The systems and methods detect an anomaly (e.g., jamming of the blades 50) using a statistical model (e.g., using Z scores). For example, the anomaly detection is performed based on statistical analyses of features such as peak to peak times and area under the curve and is used to identify anomalous events (e.g., pre-jam and post-jam events).

Further, a labeling algorithm is used to label jam events. For example, in a batch of windows, a specific jam pattern is searched (e.g., whether maximum bore and rod pressure values inside the window are greater than or equal to predetermined values, and whether peak to peak time is less than or equal to a predetermined value). If these conditions are detected in a predetermined number of windows in each batch, an event is labeled as a jam. Another condition for labeling an event as a jam may include having at least a predetermined number of windows with peak to peak times less than or equal to a predetermined value and one window having a relatively long opening time for the blades 50.

Additionally, using ground truth based labeled data and machine learning techniques, the systems and methods can create a multiclass classifier to classify the windows (or batch of windows) into specific classes of events (e.g., normal, pre-jam, and jam). Additional features can be input to the classifier using a library that can automatically extract a relatively large number of features from a times series data collected from the hydraulic pressure sensors 22.

Throughout the following description, the peak to peak time is a time between when the bore pressure drops from a peak value to subsequently when the rod pressure rises to a peak value. Essentially, the systems and methods detect if a spike in the rod pressure occurs immediately following a spike in the bore pressure. If such a signature pattern is detected, a jam is detected. Further, the features of peak to peak times and the area under the curve for the rod pressure are used for example only. Additional or alternate features can be used.

The systems and methods can predict a probability of a jam. For example, the blades 50 can jam due to various reasons such as material being stuck in the gap between the blades 50, excessive friction between the blades 50, and so on. The prediction can help in triaging various issues such as whether the blades 50 are maintained properly, whether the operator is using the equipment properly, whether the blades 50 need to be serviced (e.g., perform gap maintenance) or replaced, and so on. These and other features of the systems and methods for jam detection and gap maintenance are now described below in detail with reference to FIGS. 14-28.

FIGS. 14-16 illustrate an example of a distributed computing system in which the systems and methods for jam detection and gap maintenance can be implemented. The distributed computing system shown in FIGS. 14-16 can also be used to implement the systems and methods for detecting faults associated with the hydraulic tool 20, which are described later with reference to FIGS. 29-33. Throughout the following description, references to terms such as servers, client devices, applications and so on are for illustrative purposes only. The terms server and client device are to be understood broadly as representing computing devices with one or more processors and memory configured to execute machine readable instructions. The client device also includes the hydraulic tool 20 as shown and described above with reference to FIGS. 1-13. The terms application and computer program are to be understood broadly as representing machine readable instructions executable by the computing devices.

FIG. 14 shows a simplified example of a distributed computing system 200. The distributed computing system 200 includes a distributed communications system 210, one or more client devices 220-1, 220-2, . . . , and 220-M (collectively, client devices 220 such as the hydraulic tool 20); one or more additional client devices 225-1, 225-2, . . . , and 225-P (collectively, client devices 225 such as mobile computing devices); and one or more servers 230-1, 230-2, . . . , and 230-N (collectively, servers 230 such as cloud computing devices). M, N, P are integers greater than or equal to one.

The distributed communications system 210 may include a local area network (LAN), a wide area network (WAN) such as the Internet, or other type of network. The client devices 220 and 225 and the servers 230 may be located at different geographical locations and communicate with each other via the distributed communications system 210. The client devices 220 and 225 and the servers 230 connect to the distributed communications system 210 using wireless and/or wired connections. The servers 230 may be located a cloud (e.g., element 24 shown in FIGS. 1-13).

The client devices 225 may include smartphones, personal digital assistants (PDAs), tablets, laptop computers, personal computers (PCs), etc. The client devices 220 include the hydraulic tool 20 shown in FIGS. 1-13. The servers 230 may provide multiple services to the client devices 220 and 225. For example, the servers 230 may execute software applications developed by one or more vendors. The servers 230 may host multiple databases that are relied on by the software applications in providing services to the client devices 220 and 225. In some examples, one or more of the servers 230 execute an application that performs jam detection and prediction, and an application that detects faults associated with the hydraulic tool 20, as described below in further detail. For example, a server 230 processes sensor data received from the client device 220 such as the hydraulic tool 20 and provides alerts to a client device 225 such as a smartphone indicating status of the blades 50 of the client device 220.

FIG. 15 shows a simplified example of the client devices 220-1 and 225-1. The client device 220-1 includes hydraulic pressure sensors 253 comprised in the hydraulic tool 20 (e.g., element 22 shown in FIGS. 1-13). The client device 225-1 does not include the hydraulic pressure sensors 253. The client device 220-1, 225-1 may typically include a central processing unit (CPU) or processor 250 (e.g., the client device 220-1 may include element 36 shown in FIGS. 1-13), one or more input devices 252 (e.g., a keypad, touchpad, mouse, touchscreen, etc.), a display subsystem 254 including a display 256, a network interface 258, memory 260, and bulk storage 262.

The network interface 258 connects the client device 220-1, 225-1 to the distributed computing system 200 via the distributed communications system 210. For example, the network interface 258 may include a wired interface (for example, an Ethernet interface) and/or a wireless interface (for example, a Wi-Fi, Bluetooth, near field communication (NFC), or other wireless interface). For example, in the client device 220-1, the network interface 258 may include or communicate with the antenna 32 shown in FIGS. 1-13. The memory 260 (e.g., in the client device 220-1, element 38 shown in FIGS. 1-13) may include volatile or nonvolatile memory, cache, or other type of memory. The bulk storage 262 may include flash memory, a magnetic hard disk drive (HDD), and other bulk storage devices.

The processor 250 of the client device 220-1, 225-1 (e.g., in the client device 220-1, element 36 shown in FIGS. 1-13) executes an operating system (OS) 264 and one or more client applications 266. The client applications 266 include an application that accesses the servers 230 via the distributed communications system 210. Additionally, in the client device 220-1, the client application 266 processes data collected the hydraulic pressure sensors 22 and transmits the data to the distributed communications system 210 via the antenna 32 shown in FIGS. 1-13. The distributed communications system 210 transmits the data received from the client application 266 to one or more server applications 286 that implement the two sets of systems and methods in the servers 230, that respectively detect and predict jams in the blades 50, and that detect faults in the hydraulic tool 20 as described below in detail.

FIG. 16 shows a simplified example of the server 230-1. The server 230-1 typically includes one or more CPUs or processors 270 (e.g., element 26 shown in FIGS. 1-13), a network interface 278, memory 280 (e.g., element 28 shown in FIGS. 1-13), and bulk storage 282. In some implementations, the server 230-1 may be a general-purpose server and include one or more input devices 272 (e.g., a keypad, touchpad, mouse, and so on) and a display subsystem 274 including a display 276. The server 230-1 may be implemented in a cloud (e.g., element 24 shown in FIGS. 1-13).

The network interface 278 connects the server 230-1 to the distributed communications system 210. For example, the network interface 278 may include a wired interface (e.g., an Ethernet interface) and/or a wireless interface (e.g., a Wi-Fi, Bluetooth, near field communication (NFC), or other wireless interface). The memory 280 may include volatile or nonvolatile memory, cache, or other type of memory. The bulk storage 282 may include flash memory, one or more magnetic hard disk drives (HDDs), or other bulk storage devices.

The processor 270 of the server 230-1 (e.g., element 26 shown in FIGS. 1-13) executes an operating system (OS) 284 and one or more server applications 286, which may be implemented in a virtual machine hypervisor or containerized architecture. The bulk storage 282 may store one or more databases 288 that store data structures used by the server applications 286 to perform respective functions. The server applications 286 include an application that performs jam detection and prediction, and an application that detects faults in the hydraulic tool 20, and that communicates relevant information and messages to the client device 225-1 as described below in detail.

Throughout the following description, a hydraulic tool with a hydraulic cylinder operating a jaw or blade associated with an earth moving equipment is described for example only. The teachings of the present disclosure apply equally to any other type of equipment including but not limited to a stationary shear, a crusher, and so on, which can be generally referred to as a machine.

Figure 17:
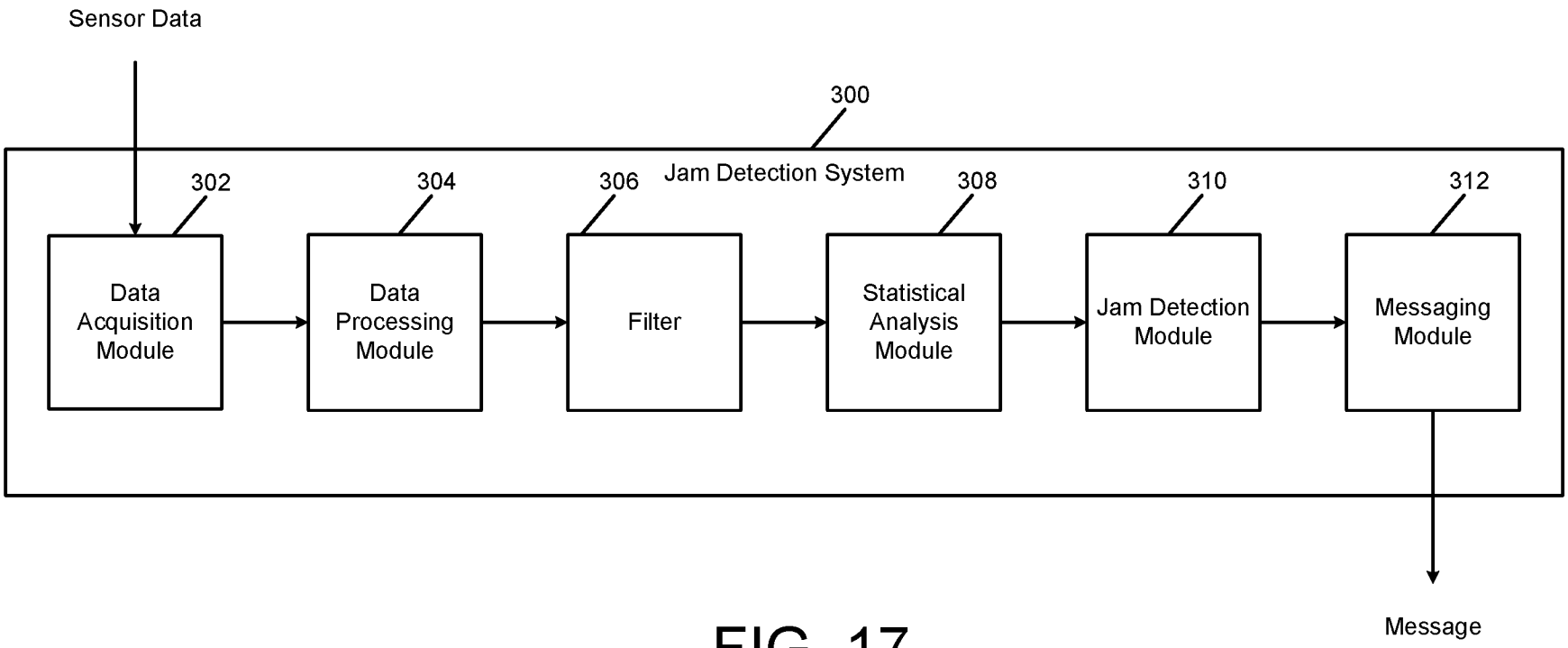
FIG. 17 shows an example of a jam detection system for detecting jamming of components of the prime mover mountable hydraulic tool of FIG. 1.

FIG. 17 shows a functional block diagram of a jam detection system 300 according to the present disclosure. The system 300 comprises a data acquisition module 302, a data processing module 304, a filter 306, a statistical analysis module 308, a jam detection module 310, and a messaging module 312. For example, the system 300 may be implemented in the server 230 shown in FIG. 16.

The data acquisition module 302 acquires a time series data regarding bore pressure and rod pressure from the hydraulic pressure sensors (e.g., elements 22 in FIGS. 1-13) monitoring the hydraulic cylinder of the hydraulic tool 20 that operates the blades 50 associated with the earth mover (e.g., element 21 shown in FIGS. 1-13). For example, the data acquisition module 302 implemented in the server 230 includes a receiver (e.g., the network interface 278 of the server 230 shown in FIG. 16) to receive the time series data from the client device 220 such as the hydraulic tool 20.

The data processing module 304 divides the time series data into a plurality of windows of a predetermined duration. The data processing module 304 identifies times at which bore pressure and rod pressure peak in the windows. The data processing module 304 determines durations between successive pairs of bore and rod pressure peaks, where in each pair, a rod pressure peak follows a bore pressure peak. These durations are called peak to peak times throughout the present disclosure. Additionally, the data processing module 304 may determine area under the curve for the rod pressure from the moment when the rod pressure spikes up to the moment when the rod pressure spikes down.

Throughout the present disclosure, the peak to peak times and area under the curve are described as the features used for jam detection and prediction. However, additional features such as maximum bore and rod pressures, window length (i.e., duration), rod pressure spike up time stamp, bore pressure spike down time stamp, and time stamps of first and last points used to calculate the area under the curve for the rod pressure may be similarly analyzed for jam detection and prediction.

The jam detection module 310 uses a statistical model implemented by the statistical analysis module 308 and detects, based on the statistical analysis performed by the statistical analysis module 308, a jamming of the blades 50 when the durations (i.e., the peak to peak times) are less than or equal to a predetermined threshold. Using the statistical model, the jam detection module 310 also detects a probability of the blades 50 jamming when the durations (i.e., the peak to peak times) between the successive pairs of bore and rod pressure peaks decrease with time (i.e., progressively occur closer together in time).

Figure 18:
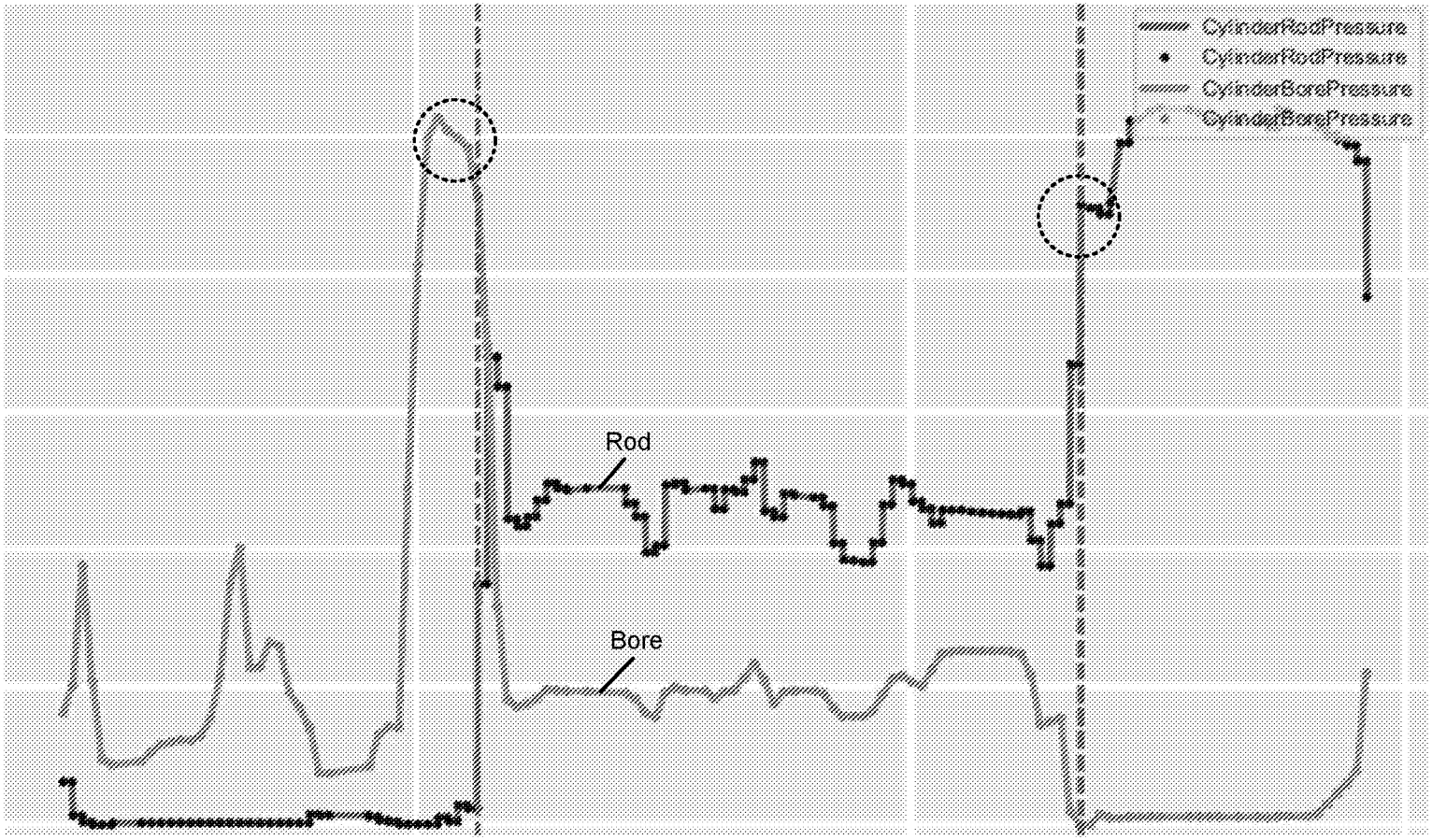
FIGS. 18-20 show graphs of various pressures associated with the prime mover mountable hydraulic tool of FIG. 1, which are utilized by the jam detection system of FIG. 17.
Figure 19:
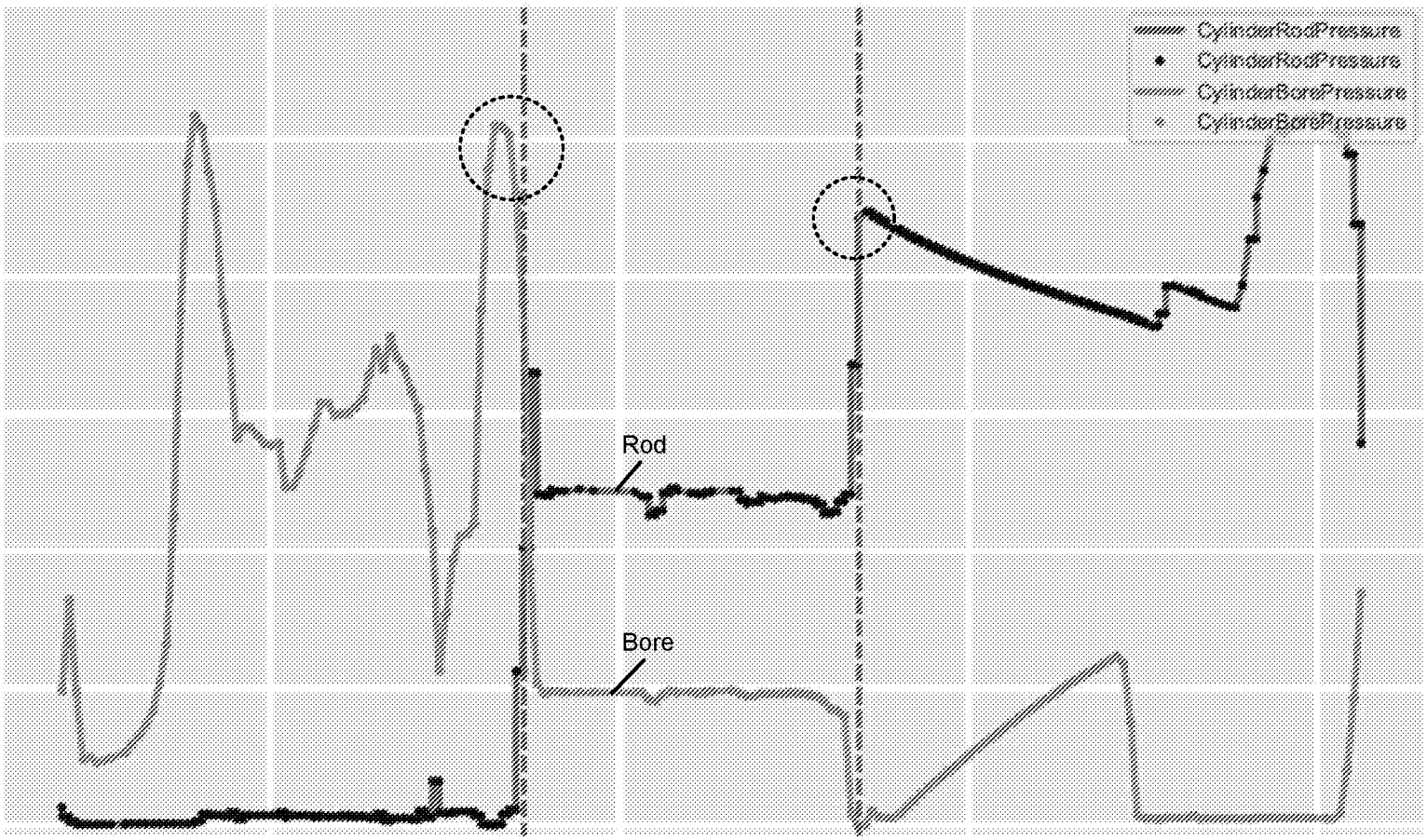
Figure 20:
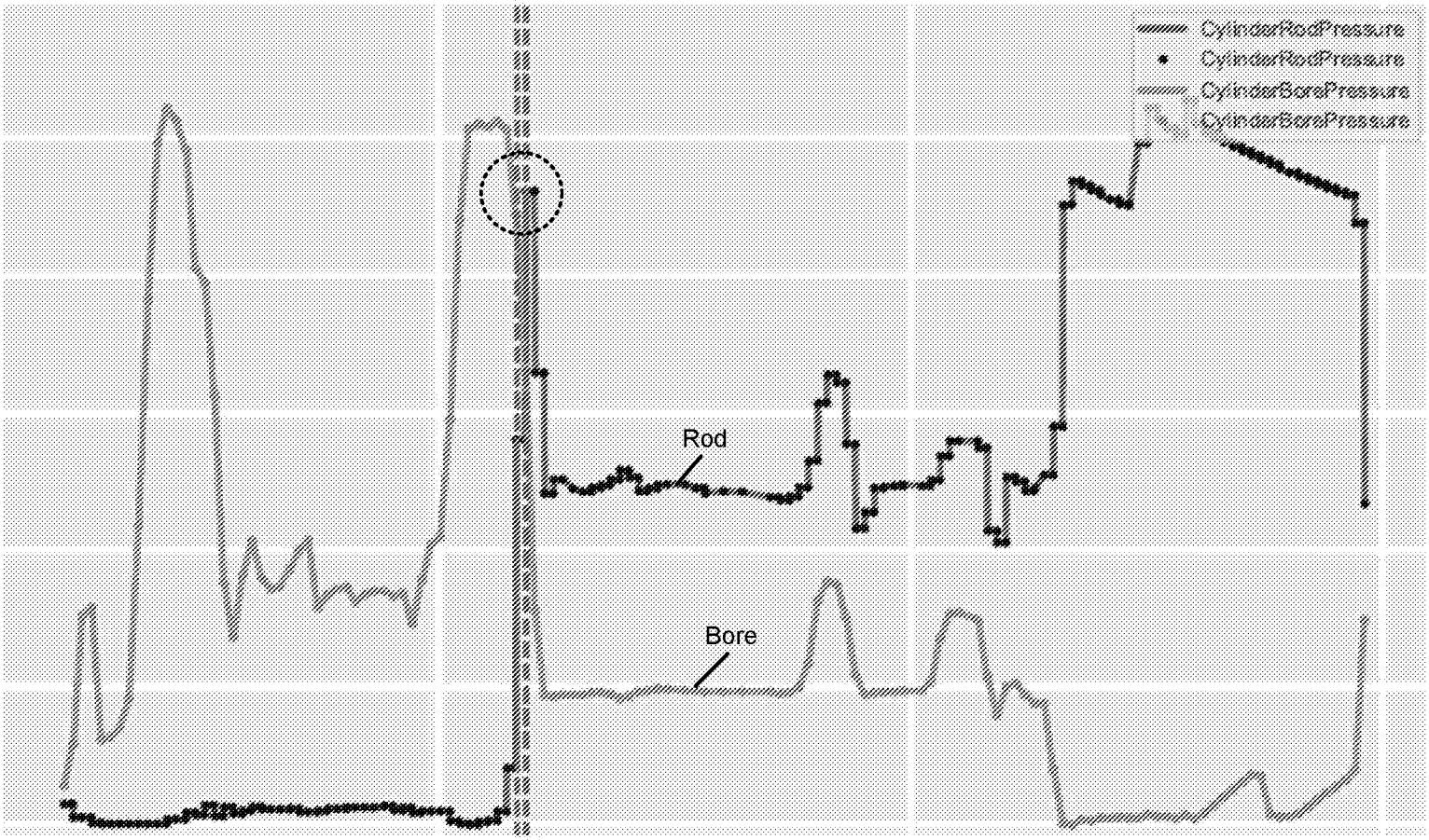

For example, FIGS. 18-20 show few examples of durations between successive pairs of bore and rod pressure peaks that progressively decrease with time. Additional examples may be used. For example, the duration between the bore and rod pressure peaks in FIG. 18 is greater than that in FIG. 19, which is greater than that in FIG. 20. Thus, from FIG. 18 to FIG. 19, durations between successive pairs of bore and rod pressure peaks decrease with time. The decrease in the durations from FIG. 18 to FIG. 19 (and additional similar data) indicates that a jam is probable, and the almost coinciding bore and rod peaks (i.e., a rod peak immediately following a bore peak) in FIG. 20 indicates an occurrence of a jam.

Additionally or alternatively, the jam detection module 310 may detect the jamming of the blades 50 by similarly analyzing the area under the curve for the rod pressure. For example, the jam detection module 310 may detect the jamming of the blades 50 when the area under the curve for the rod pressure is greater than or equal to a predetermined value. The jam detection module 310 may detect the probability of the blades 50 jamming when the area under the curve for successive rod pressure curves progressively increases with time.

The filter 306 filters, from the successive pairs of bore and rod pressure peaks, pairs with peak to peak durations greater than or equal to a predetermined duration. The filter 306 also filters, from the area under the curve for the rod pressure curves, areas greater than or equal to a predetermined area. The jam detection module 310 may operate without using rolling windows or may operate using a rolling window if the window size is relatively large. The filter 306 may also filter windows longer than a predetermined duration. The filtering eliminates outliers that can skew the jam detection results. The jam detection module 310 performs anomaly detection and identifies a jam and a probability of a jam before the jam can occur.

The statistical analysis module 308 generates mean, standard deviation, and Z scores based on the durations between successive pairs of bore and rod pressure peaks. The statistical analysis module 308 detects the jamming of the blades 50 and/or the probability of the blades 50 jamming based on the Z scores. The statistical analysis module 308 generates the Z score using values of the peak to peak durations that are less than the mean value of the durations (i.e., the anomaly detection is performed on the negative side or below the mean for the selected features such as peak to peak time and/or area under the curve). Additionally or alternatively, the statistical analysis module 308 may perform similar analysis using the area under the curve feature. For example, the statistical analysis module 308 may generate the Z score using values of the areas under the curve that are less than a mean value of the areas.

The messaging module 312 includes a transmitter to transmit a message indicating the jamming of the blades 50 and the probability of the blades 50 jamming to a computing device such as a smartphone (e.g., the client device 225). Based on the message, the user of the computing device can initiate a preventive action to prevent a jam if the message indicates that a jam is probable but has not yet occurred. If the message indicates that a jam has occurred or is imminent, the user can initiate a corrective action to rectify the jamming problem by servicing the blades 50 (e.g., by adjusting the gap between the blades 50), or by replacing the blades 50.

The messaging module 312 may generate messages indicating different severity levels of the detections by using a combination of features such as the peak to peak times and the area under the curve as follows. For example, the messaging module 312 may send a first message with a first severity level if the peak to peak duration is less than or equal to a first threshold or if the area under the curve is greater than or equal to the second threshold. The messaging module 312 may send a second message with a second severity level if both the peak to peak duration is less than or equal to the first threshold and if the area under the curve is greater than or equal to the second threshold, where the second severity level is greater than the first severity level.

Figure 22:
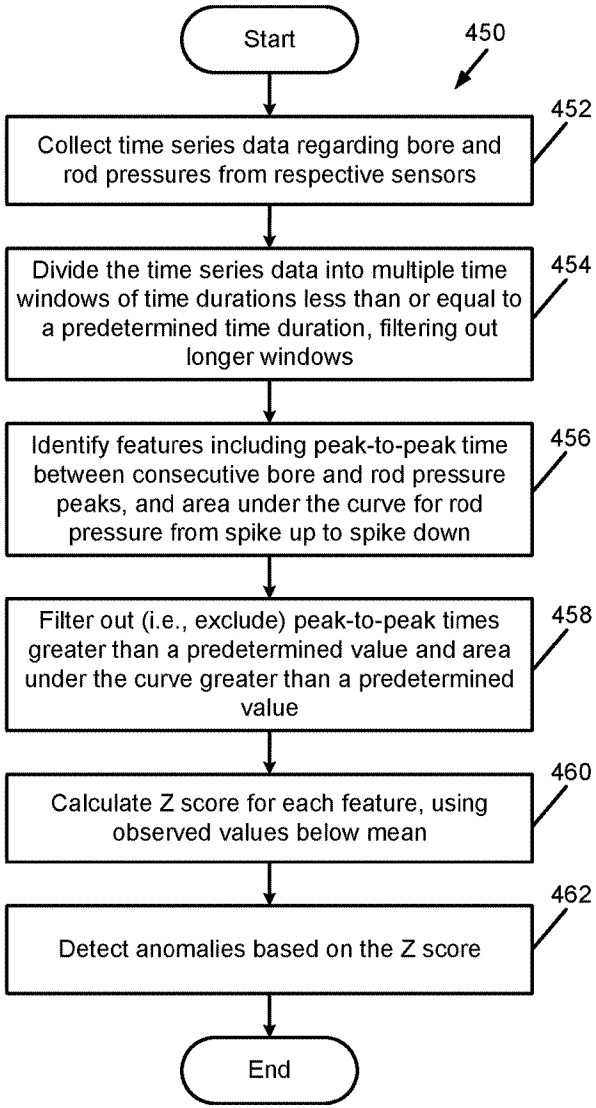
FIG. 22 shows an example of an anomaly detection method used by the jam detection system of FIG. 17.
Figure 21:
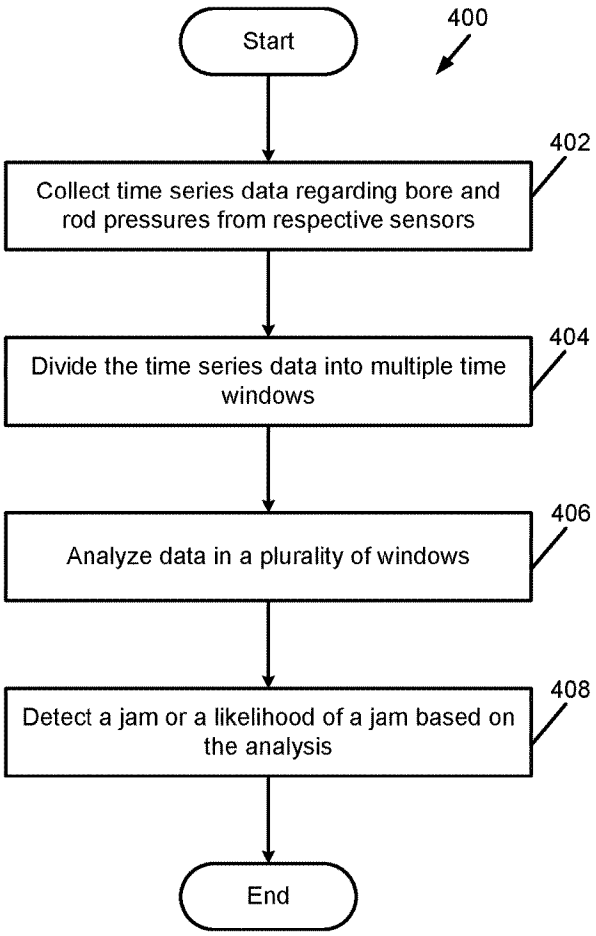
FIG. 21 shows an example of a jam detection method for detecting jamming of components of the prime mover mountable hydraulic tool of FIG. 1 used by the jam detection system of FIG. 17.
Figure 24:
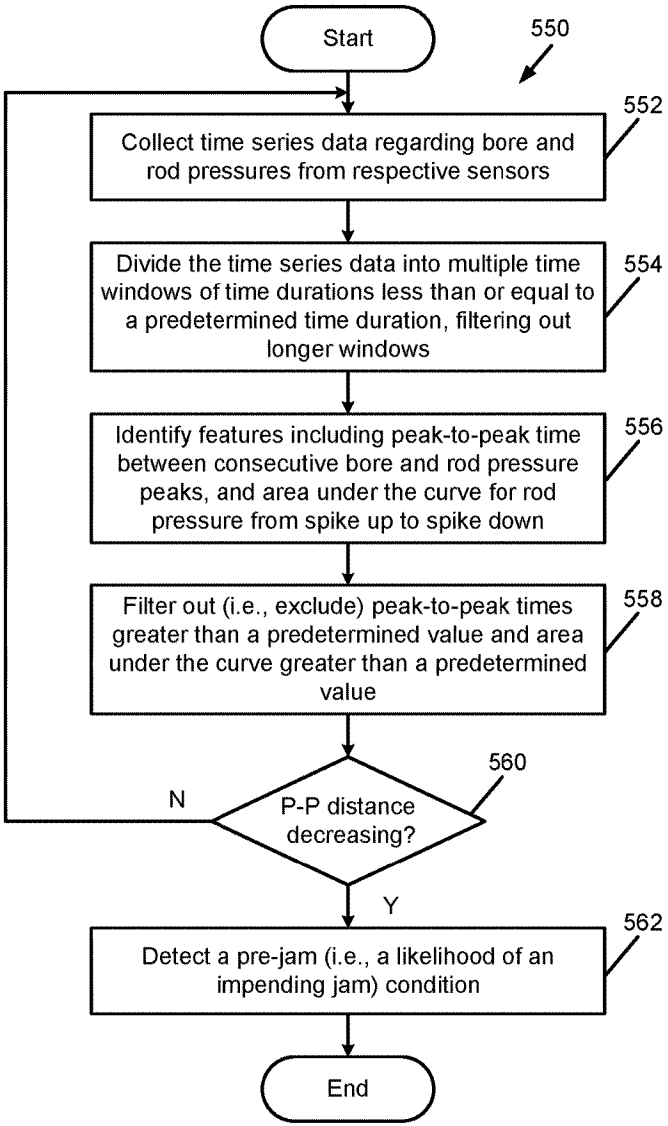
FIG. 24 shows an example of a jam prediction method used by the jam detection system of FIG. 17.
Figure 23:
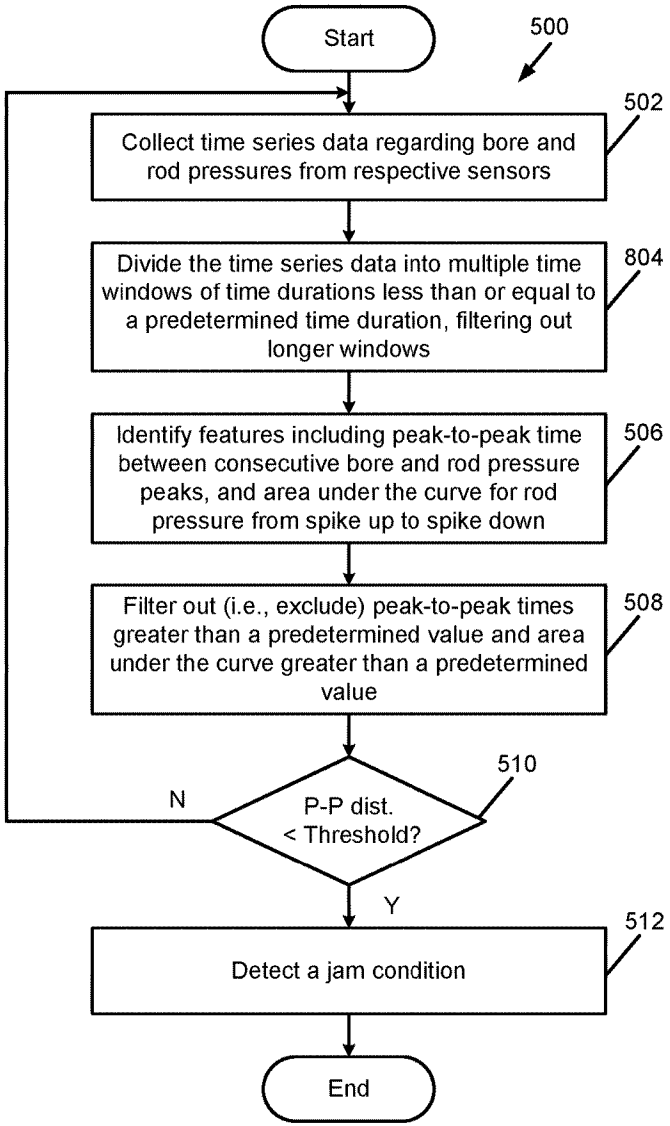
FIG. 23 shows an example of a jam detection methods used by the jam detection system of FIG. 17.
Figure 25:
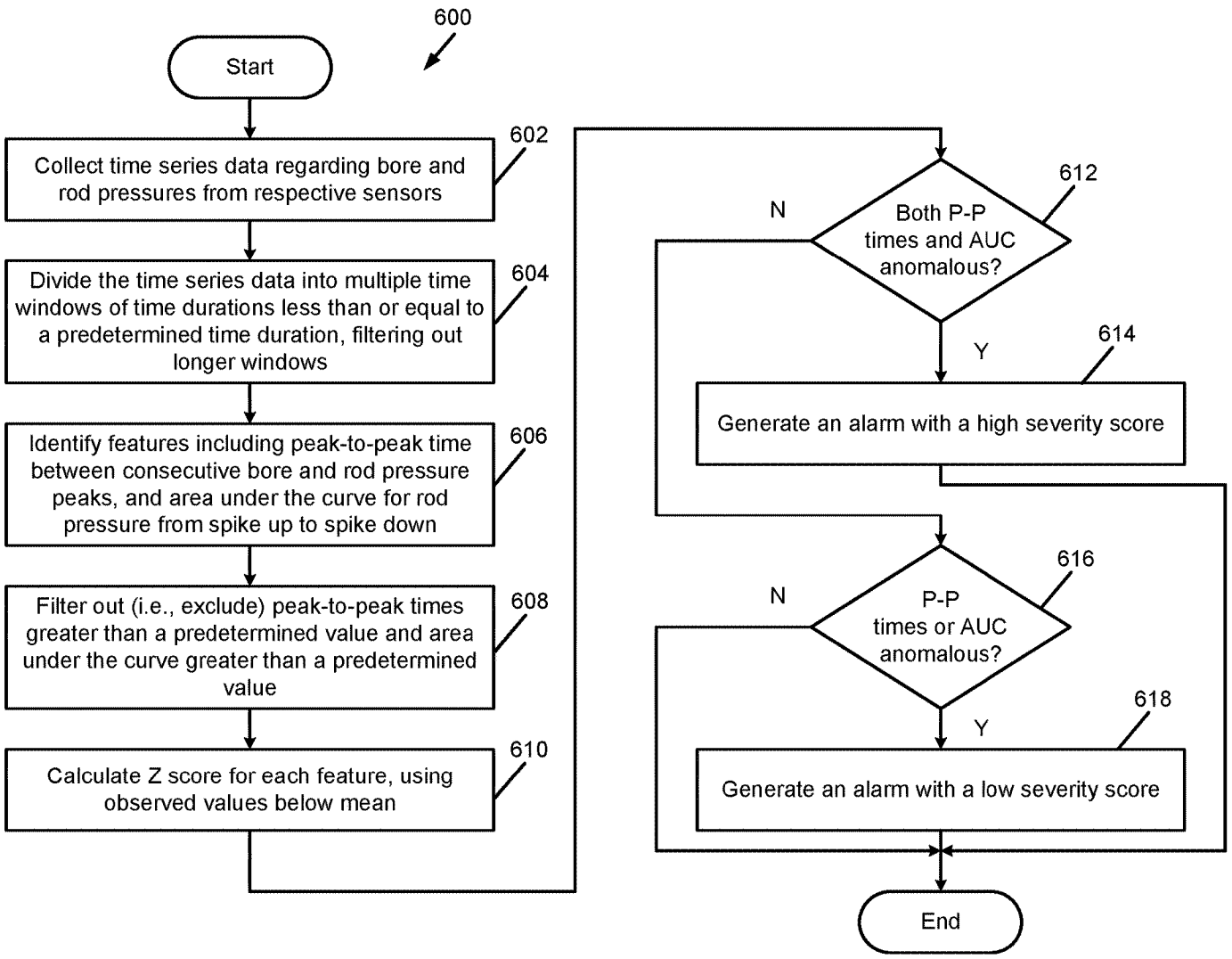
FIG. 25 shows an example of a method for scoring alarms/alerts provided by the jam detection system of FIG. 17.
Figure 26:
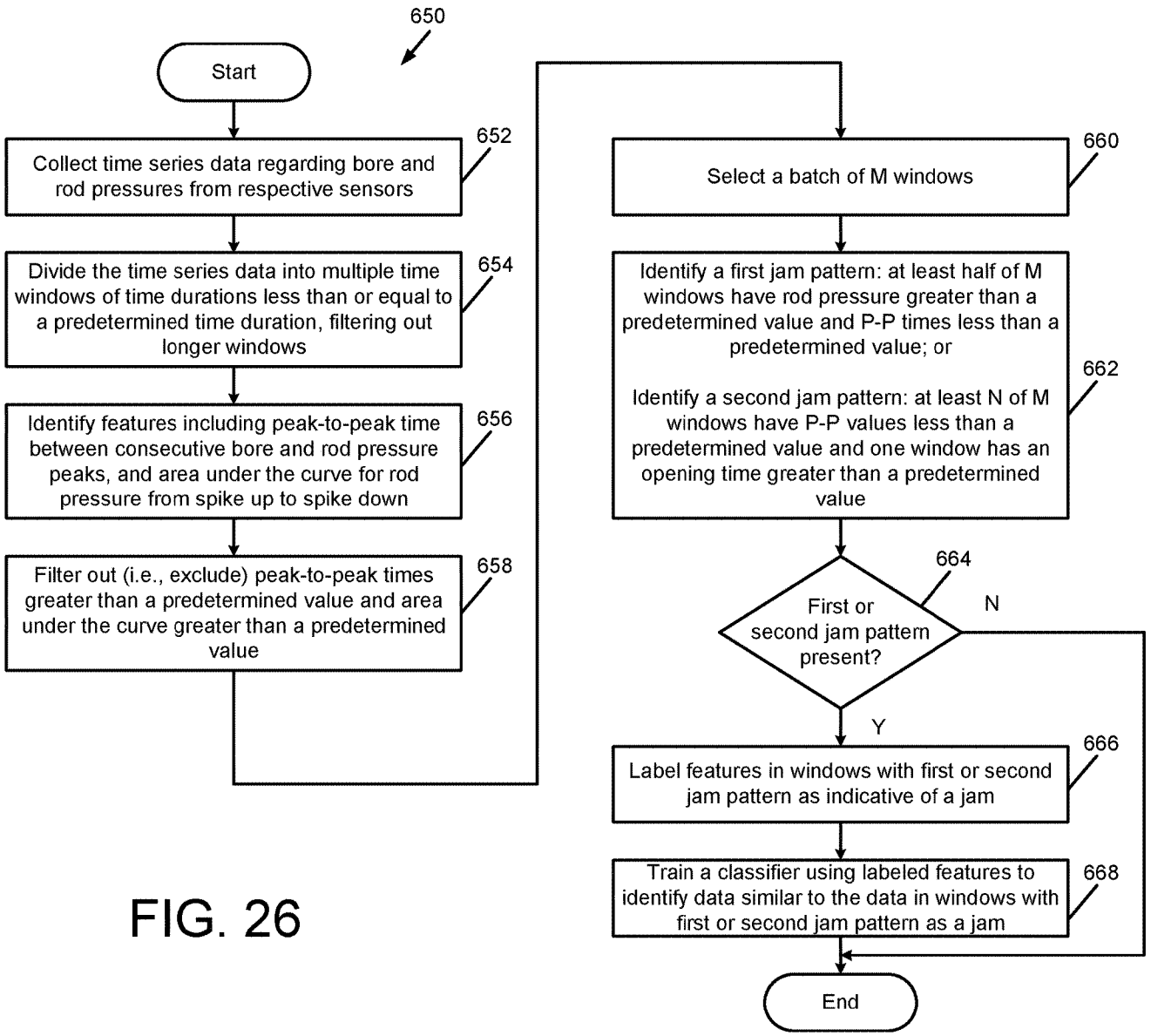
FIG. 26 shows an example of a method for labeling data processed by the jam detection system of FIG. 17.
Figure 28:
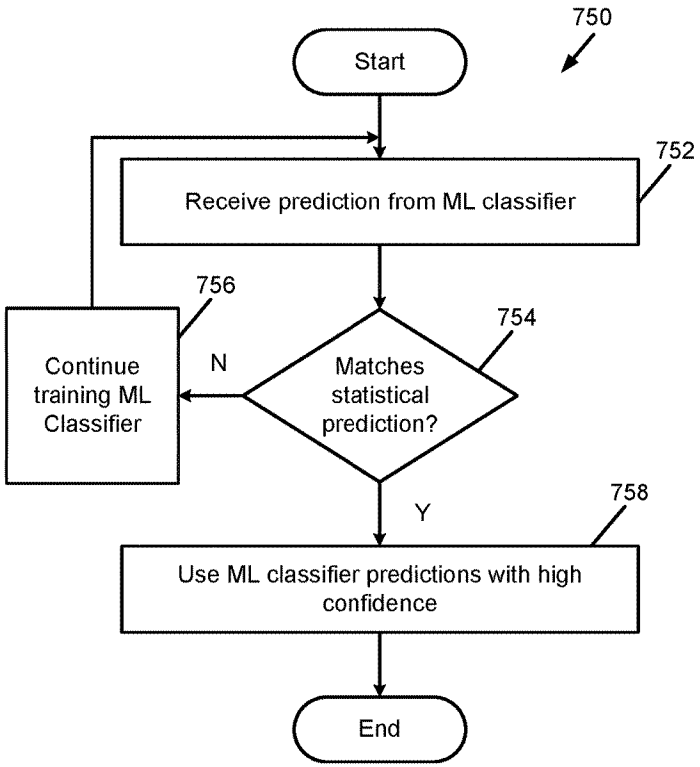
FIG. 28 shows an example of a method of further training the classifier.
Figure 27:
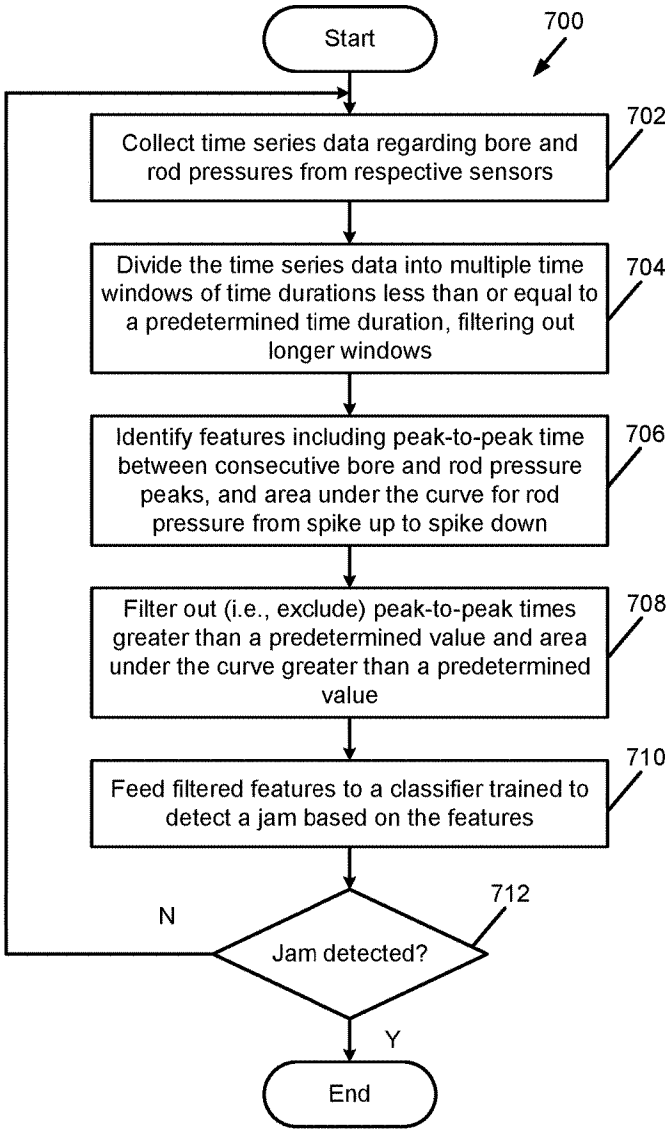
FIG. 27 shows an example of a method for detecting a jam using a classifier trained using machine learning.

FIGS. 21-28 illustrate various methods for performing jam detection and gap maintenance. These methods can be performed by one or more elements of the system 300 described above with reference to FIGS. 17-20. These methods can be implemented by the server applications 286 in the server 230 shown in FIG. 16, which can be implemented in a cloud (e.g., element 24 shown in FIGS. 1-13). Before explaining these methods in detail, a brief outline of these methods follows. Briefly, FIG. 21 illustrates the broadest method for performing jam detection and gap maintenance. FIG. 22 illustrates an anomaly detection method. FIGS. 23 and 24 respectively illustrate jam detection and jam prediction methods. FIG. 25 illustrates a method for scoring the messages (e.g., scoring alarms/alerts). FIG. 26 illustrates a method for labeling data according to the present disclosure. FIG. 27 illustrates a method for detecting a jam using a classifier trained using machine learning. FIG. 28 illustrates a method of further training the classifier. These methods are not mutually exclusive and can be performed in combination to the extent the combination is feasible. These methods are now described in detail.

FIG. 21 shows a broad method 400 for detecting or predicting the jamming of the blades 50. At 402, the method 400 collects time series data regarding bore and rod pressures from respective sensors (e.g., elements 22 shown in FIGS. 1-13) associated with a hydraulic cylinder of a hydraulic tool (e.g., element 20 shown in FIGS. 1-13). At 404, the method 400 divides the time series data into multiple time windows of a predetermined duration. At 406, the method 400 analyzes the time series data in a plurality of windows using a statistical model. At 408, the method 400 detects a jam or likelihood of a jam based on the statistical analysis.

FIG. 22 shows a method for 450 for detecting anomalies based on Z scores. At 452, the method 450 collects time series data regarding bore and rod pressures from respective sensors (e.g., elements 22 shown in FIGS. 1-13) associated with a hydraulic cylinder of a hydraulic tool (e.g., element 20 shown in FIGS. 1-13). At 454, the method 450 divides the time series data into multiple time windows of durations less than or equal to a predetermined duration, and filters out windows longer than the predetermined duration.

At 456, the method 450 identifies features including peak to peak times between consecutive bore and rod pressure peaks, and area under the curve for rod pressure from spike up to spike down. At 458, the method 450 filters out (i.e., excludes) peak to peak times greater than a predetermined value, and area under the curve greater than a predetermined value.

At 460, the method 450 calculates the Z scores for each feature using observed values of the features that are below a mean value. At 462, the method 450 detects anomalies based on the Z scores.

FIG. 23 shows a method 500 for detecting a jam condition. At 502, the method 500 collects time series data regarding bore and rod pressures from respective sensors (e.g., elements 22 shown in FIGS. 1-13) associated with a hydraulic cylinder of a hydraulic tool (e.g., element 20 shown in FIGS. 1-13). At 504, the method 500 divides the time series data into multiple time windows of durations less than or equal to a predetermined duration, and filters out windows longer than the predetermined duration.

At 506, the method 500 identifies features including peak to peak times between consecutive bore and rod pressure peaks, and area under the curve for rod pressure from spike up to spike down. At 508, the method 500 filters out (i.e., excludes) peak to peak times greater than a predetermined value, and area under the curve greater than a predetermined value.

At 510, the method 500 determines whether the peak to peak distance between consecutive or successive bore and rod pressure peaks is less than a threshold. The method 500 returns to 502 if the peak to peak distance between consecutive or successive bore and rod pressure peaks is not less than the threshold. The method 500 proceeds to 512 if the peak to peak distance between consecutive or successive bore and rod pressure peaks is less than the threshold. At 512, the method 500 detects a jam condition since the peak to peak distance between consecutive or successive bore and rod pressure peaks is less than the threshold. The method 500 may detect a jam condition by similarly analyzing the area under the curve feature.

FIG. 24 shows a method 550 for detecting a pre-jam (i.e., a likelihood of a jam) condition. At 552, the method 550 collects time series data regarding bore and rod pressures from respective sensors (e.g., elements 22 shown in FIGS. 1-13) associated with a hydraulic cylinder of a hydraulic tool (e.g., element 20 shown in FIGS. 1-13). At 554, the method 550 divides the time series data into multiple time windows of durations less than or equal to a predetermined duration, and filters out windows longer than the predetermined duration.

At 556, the method 550 identifies features including peak to peak times between consecutive bore and rod pressure peaks, and area under the curve for rod pressure from spike up to spike down. At 558, the method 550 filters out (i.e., excludes) peak to peak times greater than a predetermined value, and area under the curve greater than a predetermined value.

At 560, the method 550 determines whether the peak to peak distance between consecutive or successive bore and rod pressure peaks is progressively decreasing. The method 550 returns to 552 if the peak to peak distance between consecutive or successive bore and rod pressure peaks is not progressively decreasing. The method 550 proceeds to 556 if the peak to peak distance between consecutive or successive bore and rod pressure peaks is progressively decreasing. At 562, the method 560 detects a pre-jam (i.e., a likelihood of a jam) condition since the peak to peak distance between consecutive or successive bore and rod pressure peaks is progressively decreasing. The method 550 may detect a pre-jam (i.e., a likelihood of a jam) condition by similarly analyzing the area under the curve feature.

FIG. 25 shows a method 600 for indicating a severity level or severity score of a detected anomalous condition using a combination of features. At 602, the method 600 collects time series data regarding bore and rod pressures from respective sensors (e.g., elements 22 shown in FIGS. 1-13) associated with a hydraulic cylinder of a hydraulic tool (e.g., element 20 shown in FIGS. 1-13). At 604, the method 600 divides the time series data into multiple time windows of durations less than or equal to a predetermined duration, and filters out windows longer than the predetermined duration.

At 606, the method 600 identifies features including peak to peak times between consecutive bore and rod pressure peaks, and area under the curve for rod pressure from spike up to spike down. At 608, the method 600 filters out (i.e., excludes) peak to peak times greater than a predetermined value, and area under the curve greater than a predetermined value.

At 610, the method 600 calculates a Z score for each feature using observed values for the feature below a mean value of the future. At 612, based on the Z scores, the method 600 determines if both the peak to peak times and the area under the curve are anomalous by comparing them with their respective thresholds as described above. The method 600 proceeds to 614 if both the peak to peak times and the area under the curve are anomalous. The method proceeds to 616 and if both the peak to peak times and the area under the curve are not anomalous.

At 614, the method 600 generates an alarm with a high severity score since both the peak to peak times and the area under the curve are anomalous, and the method 600 ends.

At 616, the method 600 determines if the peak to peak times are anomalous or if the area under the curve is anomalous. The method 600 proceeds to 618 if the peak to peak times are anomalous or if the area under the curve is anomalous. The method 600 ends if neither the peak to peak times are anomalous nor the area under the curve is anomalous.

At 618, the method 600 generates an alarm with a low severity score since only one of the peak to peak times or the area under the curve are anomalous, and the method 600 ends.

FIG. 26 shows a method 650 for labeling features and training a classifier using label features. At 652, the method 650 collects time series data regarding bore and rod pressures from respective sensors (e.g., elements 22 shown in FIGS. 1-13) associated with a hydraulic cylinder of a hydraulic tool (e.g., element 20 shown in FIGS. 1-13). At 654, the method 650 divides the time series data into multiple time windows of durations less than or equal to a predetermined duration, and filters out windows longer than the predetermined duration.

At 656, the method 650 identifies features including peak to peak times between consecutive bore and rod pressure peaks, and area under the curve for rod pressure from spike up to spike down. At 658, the method 650 filters out (i.e., excludes) peak to peak times greater than a predetermined value, and area under the curve greater than a predetermined value.

At 660, the method 650 selects a batch of M windows, where M is an integer greater than one. At 662, the method 650 identifies a first jam pattern or a second jam pattern as follows. The method 650 identifies a first jam pattern if at least half of the M windows indicate that the rod pressure is greater than a predetermined value, and that the peak to the times are less than a predetermined value. The method 650 identifies a second jam pattern if at least N of M windows indicate that the peak to peak values are less than a predetermined value, and that one window indicates that an opening time of the blades 50 is greater than a predetermined value.

At 664, the method 650 determines whether a first jam pattern or a second jam pattern is present (i.e., detected). The method 650 proceeds to 666 if a first jam pattern or a second jam pattern is present (i.e., detected). The method 650 and if neither the first jam pattern nor the second jam pattern is present (i.e., detected).

At 666, the method 650 labels the features in the windows with the first or the second jam pattern as indicating a jam. At 668, the method 650 trains a classifier using the labeled features to identify data, that is similar to the data found in the windows with the first or the second jam pattern, as data indicative of a jam, and the method 650 ends.

FIG. 27 shows a method 700 for detecting a jam using a classifier trained as described with reference to FIG. 26. At 702, the method 700 collects time series data regarding bore and rod pressures from respective sensors (e.g., elements 22 shown in FIGS. 1-13) associated with a hydraulic cylinder of a hydraulic tool (e.g., element 20 shown in FIGS. 1-13). At 704, the method 700 divides the time series data into multiple time windows of durations less than or equal to a predetermined duration, and filters out windows longer than the predetermined duration.

At 706, the method 700 identifies features including peak to peak times between consecutive bore and rod pressure peaks, and area under the curve for rod pressure from spike up to spike down. At 708, the method 700 filters out (i.e., excludes) peak to peak times greater than a predetermined value, and area under the curve greater than a predetermined value.

At 710, the method 700 feeds the filtered features to a classifier trained to detect a jam based on the features. At 712, the method 700 determines if the trained classifier detects a jam based on the features. The method 700 returns to 702 if the trained classifier does not detect a jam based on the features. The method 700 ends if the trained classifier detects a jam based on the features. At this point a message indicating the detected jam may be sent.

FIG. 28 shows a method 750 for verifying the operation of a classifier trained using machine learning (called ML classifier; e.g., trained as described with reference to FIG. 26 above). At 752, the method 750 receives a prediction from a trained classifier (e.g., prediction generated as described with reference to FIG. 27 above).

At 754, the method 750 determines whether the prediction received from the ML classifier matches the prediction generated by a statistical model (e.g., the statistical model used by the system 300 described with reference to FIG. 17 above). The method 750 proceeds to 756 if the prediction received from the ML classifier does not match the prediction generated by a statistical model. The method 750 proceeds to 758 if the prediction received from the ML classifier matches the prediction generated by a statistical model.

At 756, the method 750 continues to train the ML classifier, and the method returns to 752. At 758, the method 750 uses the predictions received from the ML classifier with high confidence, and the method 750 ends.

In addition to the jam detection system and methods described above with reference to FIGS. 17-28, the present disclosure provides a system and a method for monitoring the wear of a hydraulic tool (e.g. hydraulically actuated jaws) using only pressure sensors. When a hydraulic tool is new (or has been newly serviced), various hydraulic system pressures are recorded during piston movement. Then during the tool life-cycle, similar measurements are recorded during piston movement and compared with the initially collected data to monitor changes in absolute and differential pressures ($\Delta P$) that are indicative of failures and long term wear trends.

Figure 29:
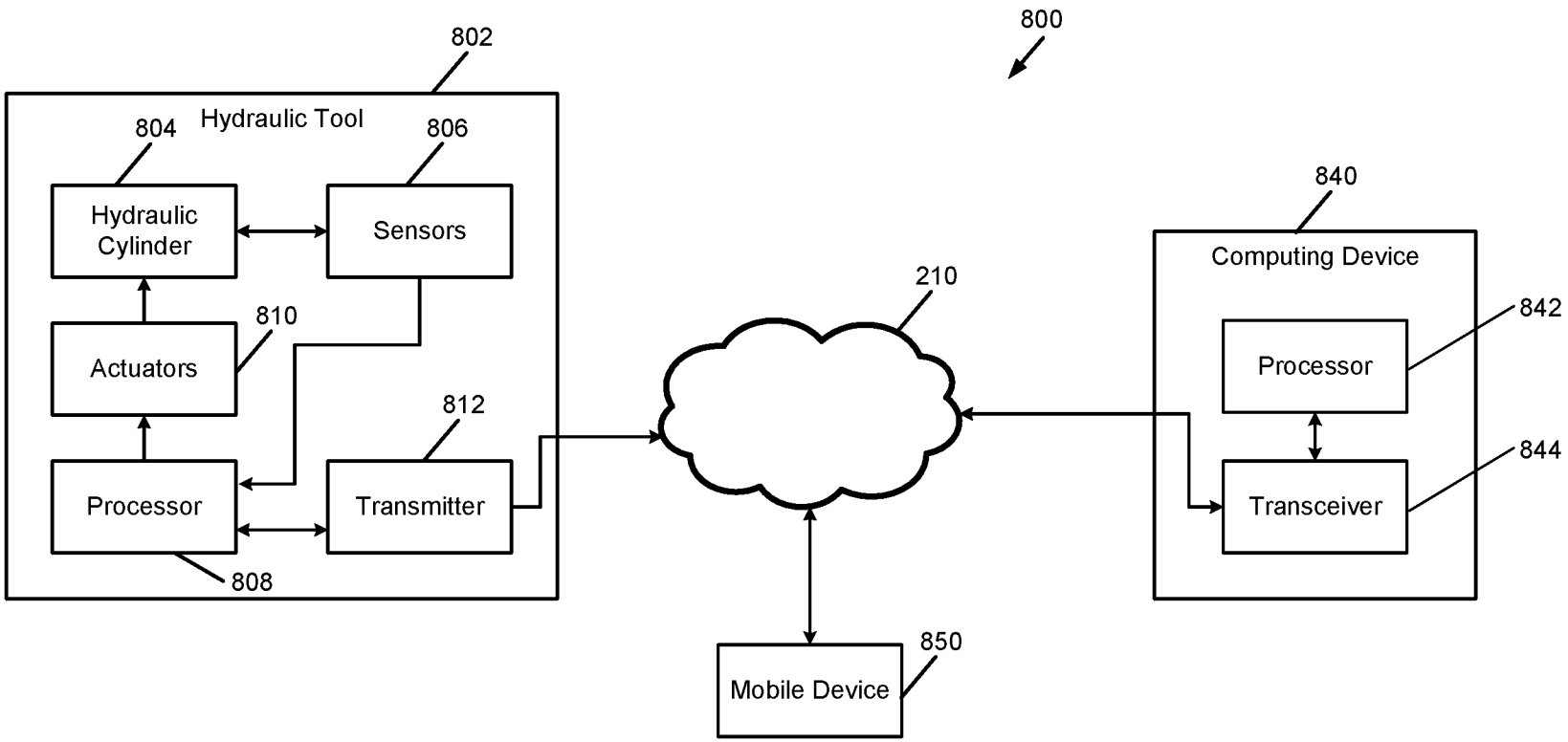
FIG. 29 shows an example of a fault detection system for detecting faults in the prime mover mountable hydraulic tool of FIG. 1.
Figure 30:
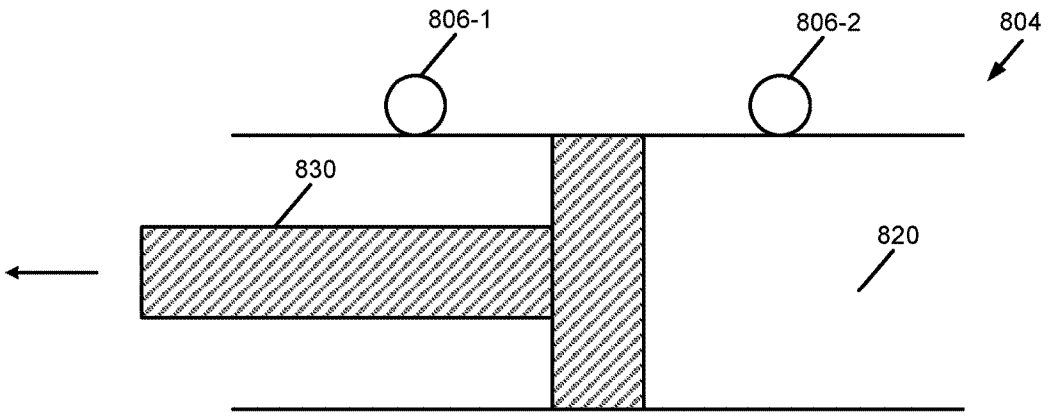
FIG. 30 shows an example of a schematic of a hydraulic cylinder associated with the prime mover mountable hydraulic tool of FIG. 1.
Figure 31:
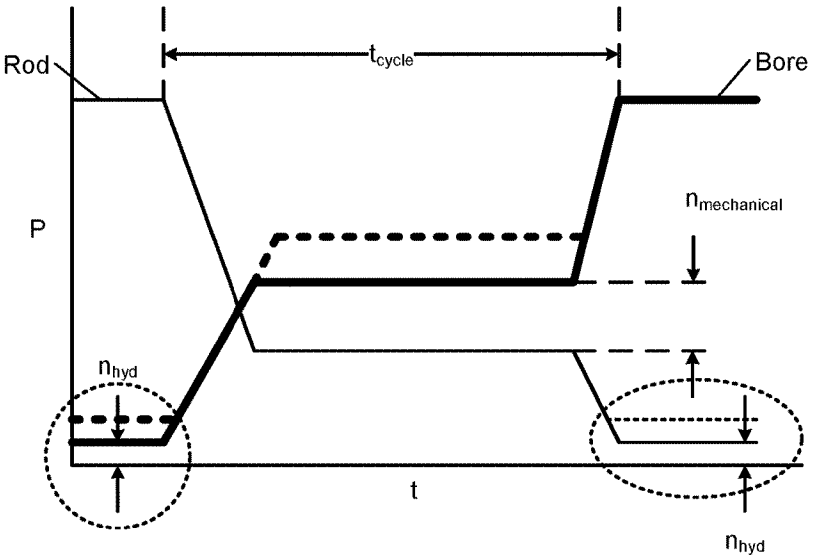
FIG. 31 shows an example of a graph of bore and rod pressures used by the fault detection system of FIG. 29.
Figure 32:
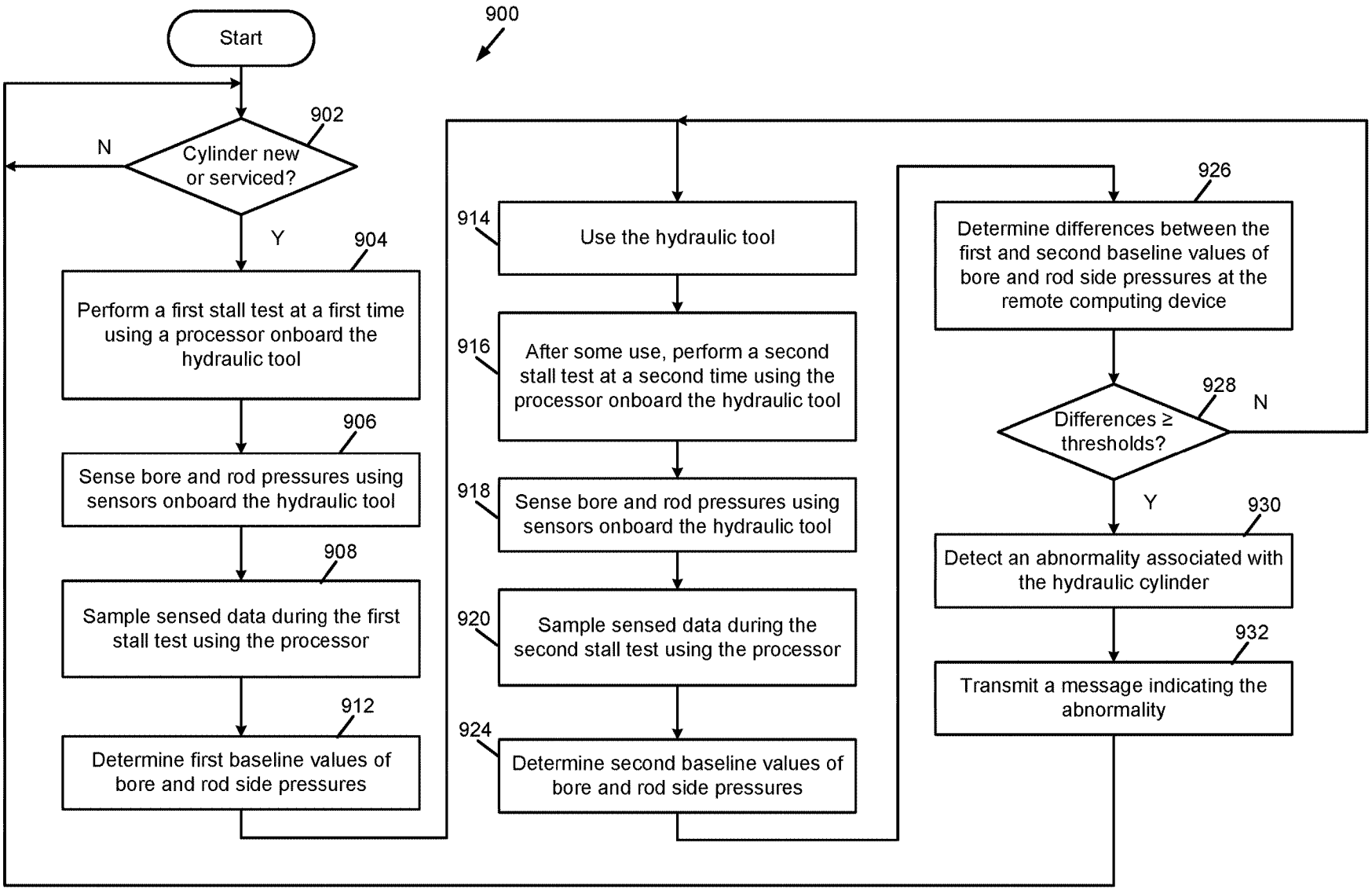
FIG. 32 shows a first example of a fault detection method for detecting faults in the prime mover mountable hydraulic tool of FIG. 1 used by the fault detection system of FIG. 29.
Figure 33:
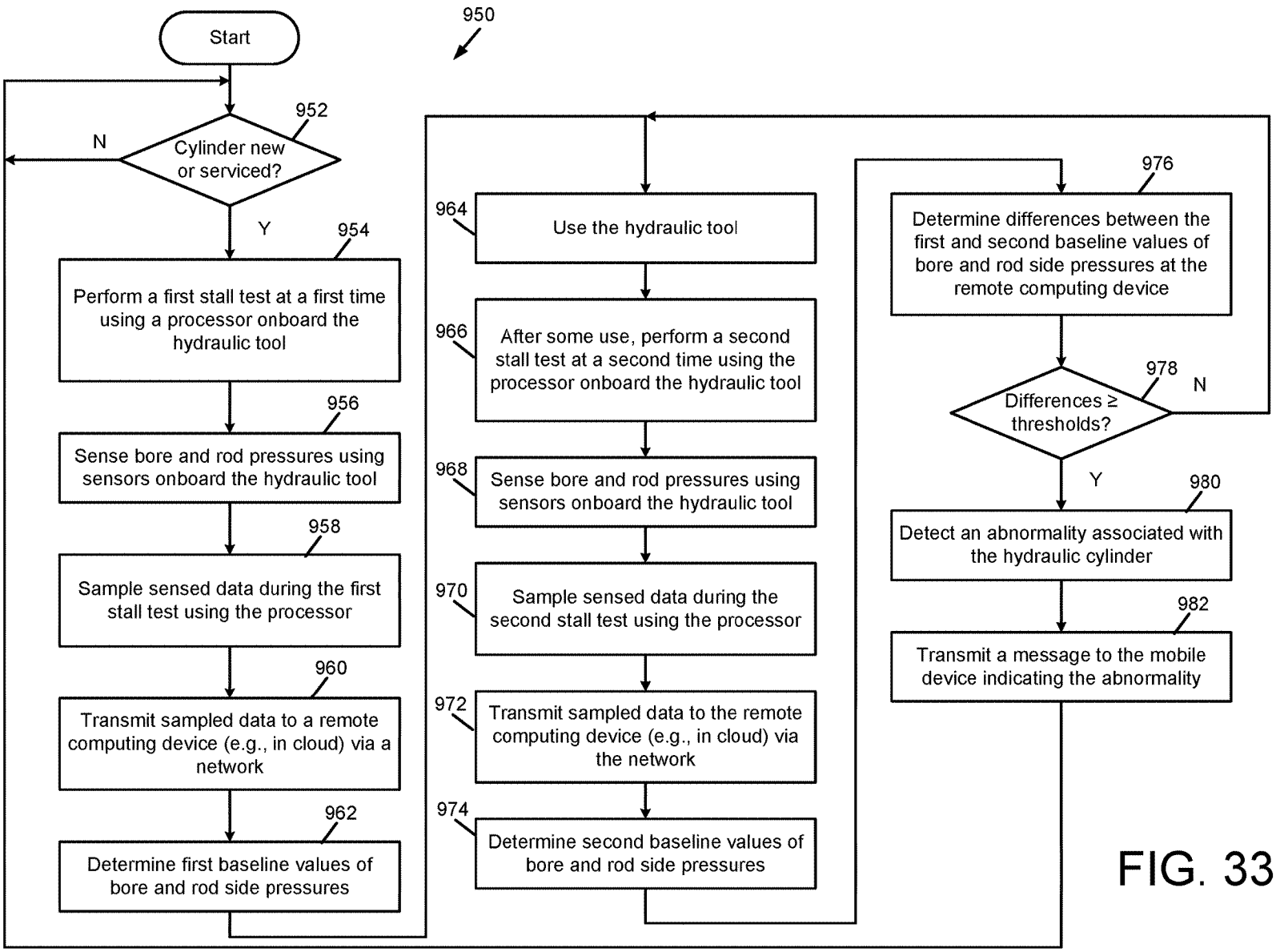
FIG. 33 shows a second example of a fault detection method for detecting faults in the prime mover mountable hydraulic tool of FIG. 1 used by the fault detection system of FIG. 29.

The following systems and methods described with reference to FIGS. 29-33 monitor and detect faults associated with the hydraulic tool 20 such as hydraulic leakage, mechanical wear, friction, and so on as explained below in detail. FIGS. 29-31 illustrate an example of a system detecting faults associated with the hydraulic tool 20. FIGS. 32 and 33 illustrate examples of methods for detecting faults associated with the hydraulic tool 20. The systems and methods for detecting faults associated with the hydraulic tool 20 shown in FIGS. 29-33 can be implemented in the distributed computing system shown in FIGS. 14-16. First, a brief overview of the systems and methods for detecting faults associated with the hydraulic tool 20 is provided. Thereafter, the systems and methods are described in detail with reference to FIGS. 29-33.

Briefly, hydraulic cylinders apply work energy to complete a task. Hydraulic cylinders need regular maintenance and servicing to ensure that they are functioning optimally. The present disclosure relates to a system and a method that allow real time monitoring of performance of a hydraulic system and identification of abnormal conditions such as leaking internal or external seals and increased mechanical wear or friction. The system and method utilize bore and rod pressure sensors 22 on either side of the hydraulic cylinder to sense hydraulic pressures in real time, and the processor 36 to measure the data and store the results locally in the memory 38 or transmit to a remote system in the cloud 24 for processing.

When installed and periodically thereafter (e.g., when serviced), the fault detection system performs a calibration procedure generally called a stall test to establish a performance baseline. During subsequent tests performed periodically after some amount of use of the hydraulic tool 20, the fault detection system compares the current test values to the baseline test values and determines based on the comparison whether mechanical friction has increased during the cylinder's operation or hydraulic fluid is potentially leaking past the internal seals and down the return line. The stall test includes a procedure to stall open the jaws or the blades 50 for a nominal period (e.g., initially 10 seconds), then close the jaws or the blades 50 for a nominal period (e.g., initially 10 seconds), and rapidly sample (e.g., initially at 10 Hz) corresponding hydraulic pressure sensors 22 and record the entire event locally or at a remote fault detection system in the cloud 24.

Other methods can be used to detect fault conditions such as leakage including flow meters, pressure sensors, tank volume sensors, and more. These methods, however, tend to have limitations on detecting increases in mechanical wear and detecting leakage past the hydraulic cylinder. For example, these methods detect leaks or large changes in pressure or flow whereas the fault detection system of the present disclosure detects relatively small changes in friction or energy to move the hydraulic cylinder, which can indicate increases in mechanical friction due to wear or lack of maintenance. The other methods may detect leakage past the cylinder with a flow meter. However, in high pressure hydraulic circuits (e.g., those in the hydraulic tool 20), this task is difficult due to the pressures involved. Flow meters designed to function with such pressures (more than 5000 psi) are not cost effective and do not function well across a wide range of flow conditions. In contrast, the fault detection system can detect leakage past the hydraulic cylinder without a flow meter.

The fault detection system of the present disclosure uses rod and bore pressure sensors (elements 22 shown in FIGS. 1-13) to detect pressures in real time. On the hydraulic tool 20, the processor 36 measures and processes the sensed pressures in real time and saves them locally in the memory 38 or transmits them to the fault detection system in the cloud 24 for processing. A server (e.g., element 230 shown in FIGS. 14-16) implements the fault detection system that stores and manages test profiles and performs test comparisons as explained below in detail. A smartphone app operates in conjunction with the fault detection system in the cloud 24 and provides a user interface (e.g., element 37 shown in FIGS. 1-13) to observe results and receive alert messages. Specifically, bore side and rod side pressures are measured by hydraulic pressure sensors 22, which are sampled in real time by the processor 36. This information is stored locally in the memory 38 or transmitted to the fault detection system in the cloud 24 as described below. A user interfaces with the data using the app on a smartphone or a computing device (e.g., the client device 225 shown in FIGS. 14-16). These and other features of the fault detection system are now described below in detail.

FIGS. 29-33 illustrate examples of a system and a method for detecting faults in the hydraulic cylinder associated with the hydraulic tool 20 in accordance with the present disclosure. FIG. 29 shows the fault detection system which is described with reference to a schematic of a hydraulic cylinder shown in FIG. 30 and a graph of bore and rod pressures shown in FIG. 31. FIG. 32 shows the fault detection method that can be performed at the hydraulic tool 20 by one or more elements of the fault detection system shown in FIG. 29. FIG. 33 shows the fault detection method that can be performed in the cloud 24 by one or more elements of the fault detection system shown in FIG. 29.

FIG. 29 shows a system 800 for detecting faults in a hydraulic system such as the hydraulic tool 20, which is schematically shown as a hydraulic tool 802. For example, the hydraulic tool 802 comprises a hydraulic cylinder 804, which comprises a bore 820 and a rod 830 as schematically shown in FIG. 30. The hydraulic tool 802 comprises sensors 806 similar to hydraulic pressure sensors 22 shown in FIGS. 1-13 that sense hydraulic pressures of the hydraulic cylinder 804. For example, a rod side pressure sensor 806-1 and a bore side pressure sensor 806-2 (collectively the sensors 806) shown in FIG. 30 respectively sense rod and bore pressures.

The hydraulic tool 802 comprises a processor 808 (e.g., elements 36 and 38 shown in FIGS. 1-13) that processes (e.g., samples) the data received from the sensors 806 as described below. The processor 808 analyzes the data and detects faults associated with the hydraulic cylinder 804 based on the analyses as explained below. The hydraulic tool 802 comprises actuators 810 that operate the hydraulic cylinder 804 (e.g., during the stall test). The processor 808 may control the actuators 810 that operate the hydraulic cylinder 804 (e.g., during the stall test). An operator of the hydraulic tool 802 initiate the stall test.

The hydraulic tool 802 comprises a transmitter 812 that communicates with the distributed communications system 210 (shown and described in detail with reference to FIGS. 14-16 above) via the antenna 32 shown in FIGS. 1-13. For example, the transmitter 812 transmits the data sensed by the sensors 806 and processed by the processor 808 to a remote computing device 840 (e.g., the server 230 shown in and described with reference to FIGS. 14-16 above) that can also perform fault detection as described below.

In some implementations, the fault detection is entirely performed at the hydraulic tool 802, and the indication of the detected fault along with the baseline data are transmitted to the cloud 24. In some implementations, the fault detection is entirely performed at remote computing device 840 in the cloud 24 based on the sensor data received from the hydraulic tool 802, and the indication of the detected fault is transmitted to the mobile device 850. In some implementations, the fault detection is partially performed at each of the hydraulic tool 802 and the remote computing device 840 in the cloud 24, and the indication of the detected fault is transmitted to the mobile device 850. Accordingly, in the following description, the processing steps are indicated as being performed at either the hydraulic tool 802 or the remote computing device 840. It should be understood that the processing steps described below as being performed at the remote computing device 840 can also be performed at the hydraulic tool 802, and vice versa.

The remote computing device 840 comprises a processor 842 (e.g., elements 26 and 28 shown in FIGS. 1-13; elements 270 and 280 shown in FIGS. 14-16) and a transceiver 844 (e.g., element 278 shown in FIGS. 14-16). The transceiver 844 receives the data processed by the processor 808 of the hydraulic tool 802. The processor 842 analyzes the data received by the transceiver 844 and detects faults associated with the hydraulic cylinder 804 based on the analyses as explained below in detail. The transceiver 844 transmits messages including the fault indications to the mobile device 850 via the distributed communications system 210. The mobile device 850 displays the messages on a user interface (e.g., element 37 shown in FIGS. 1-13).

The fault detection performed by the system 800 is described in detail with reference to FIGS. 32 and 33 below. Before that, the operation of the hydraulic cylinder 804 and the method of performing a stall test are described below with reference to FIG. 31.

FIG. 31 schematically illustrates the pressure values detected by the sensors 806 as the piston of the hydraulic cylinder 804 is driven from right to left (e.g., for causing a pair of hydraulic jaws or blades 50 to open or close) during a stall test. At first, the rod side of the hydraulic cylinder 804 is vented to the hydraulic return line, and the rod side begins an immediate and fast decrease in pressure. At the same time, the bore side is connected to the hydraulic supply and begins an immediate rise in pressure. The two pressures soon cross as seen in FIG. 31. When the bore side pressure is sufficiently greater than the rod side pressure, the piston starts to move. At mid stroke, the pressurized bore side (thick line shown in FIG. 31) is at a greater pressure than the vented rod side (thin line shown in FIG. 31). The difference in supply and return pressure at mid stroke ($\Delta P$) is labeled as $n_{mechanical}$ and is proportional to the friction (from whatever sources) in moving the piston and other features of the hydraulic tool (e.g., the jaws or blades 50 shown in FIGS. 1-13). When the piston approaches maximum left displacement, the pressure of the bore side (thick line shown in FIG. 31) increases rapidly to full/maximum pressure, whereas the pressure of the vented rod side (thin line shown in FIG. 31) decreases to near zero as the vented hydraulic fluid is exhausted, and the return line empties.

The solid thick and thin lines recorded during the stall test described above represent the baseline/new measurements. The dotted lines represent a mid-life stall test of the same parameters. With reference to the dotted circle shown in FIG. 31, the vented bore side shows in broken line a non-zero pressure $n_{hyd}$ greater than baseline due to the presence of some hydraulic fluid in the return lines from leakage around the piston or other seals. With reference to the dotted oval shown in FIG. 31, the vented rod side broken line shows a non-zero pressure $n_{hyd}$ greater than baseline due to the presence of some hydraulic fluid in the return lines from leakage around the piston or other seals.

In mid stroke, the mid-life test, indicated by dotted lines parallel to the thick lines, shows an increased bore/supply pressure and an increased differential ($\Delta P$)=$n_{mechanical}$ attributable to a number of wear factors.

During the initial stall test, similar pressure curves are recorded upon moving the piston from left to right and similarly compared with pressure data collected during hydraulic tool use for monitoring hydraulic tool wear.

Accordingly, FIG. 31 shows pressure curves that provide the following data for fault detection: $n_{mechanical}$—baseline test compared to current test provides the change in energy required to move the hydraulic cylinder due to wear or poor mechanical service; and $n_{hyd}$—baseline test compared to current test provides the change in hydraulic pressure and fluid leaking past the internal seals or other components.

Notably, the fault detection system of the present disclosure is a stand-alone system that is located on the hydraulic tool 20 and that reports to the user without relying on, going through, or being connected to the prime mover's computing and control systems. The fault detection system monitors hydraulic system parameters, analyzes the parameters in the cloud (not onboard the machine or in a prime mover mounted CPU), and transmits reports/alerts and other messages to the users' computing devices such as smartphones.

More specifically, in an implementation in which the fault detection is performed at the computing device 840, the transceiver 844 receives data via the distributed communications system 210 from the first sensor 806-2 sensing pressure on the bore side of the hydraulic cylinder 804 associated with a hydraulic tool 802 and from the second sensor 806-1 sensing pressure on the rod side of the hydraulic cylinder 804 associated with the hydraulic tool 802. The data includes multiple samples of the pressures taken during each of first and second test operations (e.g., stall tests) performed by the hydraulic cylinder 804 at first and second times, respectively.

The processor 842 determines first baseline values of the pressures on the bore side and the rod side of the hydraulic cylinder 804 based on the data received from the first and second sensors 806 during the first test operation performed by the hydraulic cylinder 804 at the first time. Subsequently, after some use of the hydraulic tool 802, the processor 842 determines second baseline values of the pressures on the bore side and the rod side of the hydraulic cylinder 804 based on the data received from the first and second sensors 806 during the second test operation performed by the hydraulic cylinder 804 at the second time, which is later than the first time.

The processor 842 detects an abnormality associated with the hydraulic cylinder 804 based on the first and second baseline values of the pressures on the bore side and the rod side of the hydraulic cylinder 804. The processor 842 detects the abnormality based on whether the differences between the first and second baseline values are greater than or equal to predetermined thresholds. The abnormality includes one or more of a fluid leakage, mechanical wear, and friction associated with the hydraulic cylinder 804. The transceiver 844 transmits a message to the mobile device 850 via the distributed communications system 210 indicating detection of the abnormality associated with the hydraulic cylinder 804.

At the hydraulic tool 802, the first sensor 806-2 is arranged in an enclosure (e.g., element 30 shown in FIGS. 1-13) located on the hydraulic tool 802 to sense pressure on the bore side of the hydraulic cylinder 804 associated with the hydraulic tool 802. The second sensor 806-1 is arranged in the enclosure (e.g., element 30 shown in FIGS. 1-13) located on the hydraulic tool 802 to sense pressure on the rod side of the hydraulic cylinder 804 associated with the hydraulic tool 802.

The transmitter 812 is arranged in the enclosure (e.g., element 30 shown in FIGS. 1-13) located on the hydraulic tool 802 to transmit data to the distributed communications system 210 when the first and second stall tests are performed by the hydraulic cylinder 804 at first and second times, respectively. The processor 808 is arranged in the enclosure (e.g., element 30 shown in FIGS. 1-13) located on the hydraulic tool 802 to sample the pressures sensed by the first and second sensors 806 multiple times during each of the first and second test operations performed by the hydraulic cylinder 804 at first and second times, respectively.

The transmitter 812 transmits the samples generated by the processor 808 to the remote computing device 840 via the distributed communications system 210 for detecting an abnormality associated with the hydraulic cylinder 804 based on the samples, where the abnormality includes one or more of a fluid leakage, mechanical wear, and friction associated with the hydraulic cylinder.

As explained above, the remote computing device 840 determines first baseline values of the pressures on the bore side and the rod side of the hydraulic cylinder 804 based on the samples collected during the first test operation (e.g., first stall test) performed by the hydraulic cylinder 804 at the first time. The remote computing device 840 determines second baseline values of the pressures on the bore side and the rod side of the hydraulic cylinder 804 based on the data collected during the second test operation (e.g., second stall test) performed by the hydraulic cylinder 804 at the second time.

The remote computing device 840 detects the abnormality associated with the hydraulic cylinder 804 based on whether the differences between the first and second baseline values are greater than or equal to predetermined thresholds. The remote computing device 840 transmits a message to the mobile device 850 via the distributed communications system 210 indicating the detection of the abnormality associated with the hydraulic cylinder 804.

In an implementation in which the fault detection is performed at the hydraulic tool 802, the processor 808 samples data received from the first sensor 806-2 sensing pressure on the bore side of the hydraulic cylinder 804 associated with a hydraulic tool 802 and from the second sensor 806-1 sensing pressure on the rod side of the hydraulic cylinder 804 associated with the hydraulic tool 802. The processor 808 takes multiple samples of the pressures during each of first and second test operations (e.g., stall tests) performed by the hydraulic cylinder 804 at first and second times, respectively.

The processor 808 determines first baseline values of the pressures on the bore side and the rod side of the hydraulic cylinder 804 based on the data received from the first and second sensors 806 during the first test operation performed by the hydraulic cylinder 804 at the first time. Subsequently, after some use of the hydraulic tool 802, the processor 808 determines second baseline values of the pressures on the bore side and the rod side of the hydraulic cylinder 804 based on the data received from the first and second sensors 806 during the second test operation performed by the hydraulic cylinder 804 at the second time, which is later than the first time.

The processor 808 detects an abnormality associated with the hydraulic cylinder 804 based on the first and second baseline values of the pressures on the bore side and the rod side of the hydraulic cylinder 804. The processor 808 detects the abnormality based on whether the differences between the first and second baseline values are greater than or equal to predetermined thresholds. The abnormality includes one or more of a fluid leakage, mechanical wear, and friction associated with the hydraulic cylinder 804. The transmitter 812 transmits a message to the remote computing device 850 (or to the mobile device 850) via the distributed communications system 210 indicating detection of the abnormality associated with the hydraulic cylinder 804.

FIG. 32 shows a method 900 for fault detection. For example, one or more elements of the system 800 can perform the method 900. In the method 900, the fault detection is performed at the hydraulic tool 802. A method for performing fault detection at the remote computing device 840 in the cloud 24 is described below with reference to FIG. 33. Note that in some implementations, some operations associated with the fault detection may be performed at the hydraulic tool 802, and some other operations associated with the fault detection may be performed at the remote computing device 840 in the cloud 24.

At 902, the method 900 determines whether the hydraulic cylinder is newly installed or serviced. The method 900 proceeds to 904 if the hydraulic cylinder is newly installed or serviced.

At 904, the method 900 performs a first stall test at a first time using the processor 808 (e.g., element 36 shown in FIGS. 1-13) onboard the hydraulic tool 802 (e.g., element 20 shown in FIGS. 1-13). At 906, the method 900 senses first bore and rod side pressures using the sensors 806 (e.g., elements 22 shown in FIGS. 1-13) onboard the hydraulic tool 802. At 908, the method 900 samples the sensed data during the first stall test using the processor 808.

At 912, at the hydraulic tool 802, the method 900 determines first baseline values of bore side and rod side pressures based on the first sampled data. At 914, the method 900 then allows the hydraulic tool 802 to be used to perform normal operations.

At 916, after the hydraulic tool 802 is used for some time, the method 900 performs a second stall test at a second time using the processor 808 (e.g., element 36 shown in FIGS. 1-13) onboard the hydraulic tool 802 (e.g., element 20 shown in FIGS. 1-13). At 918, the method 900 senses second bore and rod side pressures using the sensors 806 (e.g., elements 22 shown in FIGS. 1-13) onboard the hydraulic tool 802. At 920, the method 900 samples the sensed data during the second stall test using the processor 808. At 924, at the hydraulic tool 802, the method 900 determines second baseline values of bore side and rod side pressures based on the second sampled data.

At 926, at the hydraulic tool 802, the method 900 determines differences between the first and second baseline values of bore and rod side pressures. At 928, the method 900 determines whether the differences are greater than or equal to respective thresholds. The method 900 returns to 914 if the differences are not greater than or equal to the respective thresholds. The method 900 proceeds to 930 if the differences are greater than or equal to the respective thresholds.

At 930, the method 900 detects an abnormality (i.e., a fault such as leakage, friction, wear, and so on) associated with the hydraulic cylinder 804 since the differences between the first and second baseline values of bore and rod side pressures are greater than or equal to the respective thresholds. At 932, the method 900 transmits a message indicating the detected abnormality so that the user can perform appropriate corrective action such as servicing or replacing the hydraulic cylinder 804, and the method 900 returns to 902. For example, the method 900 transmits the message to the remote computing device 840 or the mobile device 850 via the distributed communications system 210 (e.g., using the transceiver 812 and the antenna 32 shown in shown in FIGS. 1-13).

FIG. 33 shows a method 950 for fault detection. For example, one or more elements of the system 800 can perform the method 950. In the method 950, the fault detection is performed at the remote computing device 840 based on the data received from the hydraulic tool 802 as follows.

At 952, the method 950 determines whether the hydraulic cylinder is newly installed or serviced. The method 950 proceeds to 950 if the hydraulic cylinder is newly installed or serviced.

At 954, the method 950 performs a first stall test at a first time using the processor 808 (e.g., element 36 shown in FIGS. 1-13) onboard the hydraulic tool 802 (e.g., element 20 shown in FIGS. 1-13). At 956, the method 950 senses first bore and rod side pressures using the sensors 806 (e.g., elements 22 shown in FIGS. 1-13) onboard the hydraulic tool 802. At 958, the method 950 samples the sensed data during the first stall test using the processor 808. At 960, the method 950 transmits the first sampled data to the remote computing device 840 via the distributed communications system 210 (e.g., using the transceiver 812 and the antenna 32 shown in shown in FIGS. 1-13).

At 962, at the remote computing device 840, the method 950 determines first baseline values of bore side and rod side pressures based on the first sampled data received from the hydraulic tool 802. At 964, the method 900 then allows the hydraulic tool 802 to be used to perform normal operations.

At 966, after the hydraulic tool 802 is used for some time, the method 950 performs a second stall test at a second time using the processor 808 (e.g., element 36 shown in FIGS. 1-13) onboard the hydraulic tool 802 (e.g., element 20 shown in FIGS. 1-13). At 968, the method 950 senses second bore and rod side pressures using the sensors 806 (e.g., elements 22 shown in FIGS. 1-13) onboard the hydraulic tool 802.

At 970, the method 950 samples the sensed data during the second stall test using the processor 808. At 972, the method 950 transmits the second sampled data to the remote computing device 840 via the distributed communications system 210 (e.g., using the transceiver 812). At 974, at the remote computing device 840, the method 950 determines second baseline values of bore side and rod side pressures based on the second sampled data received from the hydraulic tool 802.

At 976, the method 950 determines differences between the first and second baseline values of bore and rod side pressures at the remote computing device 840. At 978, the method 950 determines whether the differences are greater than or equal to respective thresholds. The method 950 returns to 964 if the differences are not greater than or equal to the respective thresholds. The method 950 proceeds to 980 if the differences are greater than or equal to the respective thresholds.

At 980, the method 950 detects an abnormality (i.e., a fault such as leakage, friction, wear, and so on) associated with the hydraulic cylinder 804 since the differences between the first and second baseline values of bore and rod side pressures are greater than or equal to the respective thresholds. At 982, the method 950 transmits a message to the mobile device 850 indicating the detected abnormality so that the user can perform appropriate corrective action such as servicing or replacing the hydraulic cylinder 804, and the method 950 returns to 952. For example, the method 950 transmits the message from the remote computing device 840 to the mobile device 850 via the distributed communications system 210 (e.g., using the transceiver 812 and the antenna 32 shown in shown in FIGS. 1-13).

While not shown, the fault detection system can use additional onboard sensors (e.g., temperature sensors, accelerometers, and so on). Using a combination of these sensors during tool use, the hydraulic tool 802 can transmit sensed parameters off-site (e.g., to the computing device 840 in the cloud 24) for remote processing, where the processed output is communicated to users via their smartphones (e.g., as tool service notifications, alerts that the tool is being misused as determined from pressure spikes, location of the tool, how long until next service, and so on). The output communicated to the users may depend on the range of onboard sensors and a level of subscription paid by the users (e.g., more types of information may be communicated in proportion to a higher level subscription).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A system comprising:

a data acquisition module configured to acquire a time series data regarding bore pressure and rod pressure from sensors monitoring a hydraulic cylinder operating a jaw or blade associated with a machine;

a data processing module configured to:

divide the time series data into a plurality of windows of a predetermined duration;

identify times at which bore pressure and rod pressure peak in the windows; and determine durations between successive pairs of bore pressure peaks and rod pressure peaks, wherein in each pair, a rod pressure peak follows a bore pressure peak;

a jam detection module configured to:

detect a jamming of the jaw or blade in response to one of the durations being less than or equal to a predetermined threshold; and detect a probability of the jaw or blade jamming in response to the durations between the successive pairs of bore pressure peaks and rod pressure peaks decreasing with time; and a messaging module configured to output a message including an indication of the detected jamming of the jaw or blade in response to one of the durations being less than or equal to the predetermined threshold and an indication of the probability of the jaw or blade jamming in response to the durations between the successive pairs of bore pressure peaks and rod pressure peaks decreasing with time.

2. The system of claim 1 further comprising a filter configured to filter, from the successive pairs of bore pressure peaks and rod pressure peaks, pairs with durations greater than or equal to a predetermined duration.

3. The system of claim 1 further comprising a statistical analysis module configured to:

generate a Z score based on the durations between the successive pairs of bore pressure peaks and rod pressure peaks; and detect at least one of the jamming of the jaw or blade and the probability of the jaw or blade jamming based on the Z score.

4. The system of claim 3 wherein the statistical analysis module is further configured to generate the Z score using values of the durations that are less than a mean of the durations.

5. The system of claim 1 wherein the messaging module comprises a transmitter configured to transmit the message indicating at least one of the jamming of the jaw or blade and the probability of the jaw or blade jamming to a computing device.

6. The system of claim 1 wherein:

the data processing module is further configured to determine area under the curve for each rod pressure curve; and the jam detection module is further configured to:

detect the jamming of the jaw or blade in response to the area under the curve for one of the rod pressure curves being greater than or equal to a second threshold; and detect the probability of the jaw or blade jamming in response to the area under the curve for successive rod pressure curves increasing with time.

7. The system of claim 6 further comprising a filter configured to filter, from the area under the curve for the rod pressure curves, areas greater than or equal to a predetermined area.

8. The system of claim 6 further comprising a statistical analysis module configured to:

generate a Z score based on the area under the curve for the rod pressure curves; and detect at least one of the jamming of the jaw or blade and the probability of the jaw or blade jamming based on the Z score.

9. The system of claim 8 wherein the statistical analysis module is further configured to generate the Z score using values of the areas that are less than a mean of the areas.

10. The system of claim 6 wherein the messaging module comprises a transmitter configured to transmit to a computing device:

a first message with a first severity level in response to the one of the durations being less than or equal to the predetermined threshold or the area under the curve being greater than or equal to the second threshold; and a second message with a second severity level in response to the one of the durations being less than or equal to the predetermined threshold and the area under the curve being greater than or equal to the second threshold, wherein the second severity level is greater than the first severity level.

* * * * *